US006550082B2

(12) United States Patent
Tharalson et al.

(10) Patent No.: US 6,550,082 B2
(45) Date of Patent: Apr. 22, 2003

(54) ADJUSTABLE CO-SLEEPER NEST

(75) Inventors: Douglas Tharalson, Aguora, CA (US); Diana Tharalson, Aguora, CA (US)

(73) Assignee: Arms Reach Concepts, Inc., Malibu, CA (US)

( * ) Notice: Subject to any disclaimer, the term of this patent is extended or adjusted under 35 U.S.C. 154(b) by 125 days.

(21) Appl. No.: 09/752,316

(22) Filed: Jan. 2, 2001

(65) Prior Publication Data

US 2002/0083524 A1 Jul. 4, 2002

(51) Int. Cl.[7] ..... A47D 7/04
(52) U.S. Cl. ..... 5/95; 5/93.1; 5/11; 5/100
(58) Field of Search ..... 411/269; 248/231.21; 5/95, 93.1, 100, 11; 403/365, 371

(56) References Cited

U.S. PATENT DOCUMENTS 322,645 A * 7/1885 Schlichting ..... 5/9.1
918,789 A * 4/1909 Spear ..... 5/95
6,112,347 A * 9/2000 Tharalson et al. ..... 5/95
6,148,456 A * 11/2000 Tharalson et al. ..... 5/99.1

* cited by examiner

*Primary Examiner*—Thomas B. Will
*Assistant Examiner*—Lisa Saldano
(74) *Attorney, Agent, or Firm*—David A. Belasco; Belasco Jacobs & Townsley, LLP

(57) ABSTRACT

An adjustable co-sleeper nest is described. The invention, in a first embodiment, comprises a baby crib having a removable front wall and four supporting rails attached to the back and side walls of the crib structure. A platform having a back wall, first and second side walls, and a reduced height front wall formed of flexible material is adjustably suspended from the supporting rails. A mattress pad is supported upon the platform structure within the walls of the platform. The platform and mattress pad extend beyond the side walls of the crib for a predetermined distance so that the mattress will fit snugly against the edge of a parental bed. Devices are provided for adjusting and securing the height of the co-sleeper platform. Straps are provided for securing the crib to the side of the parental bed. In a second embodiment, the co-sleeper nest is free-standing within an existing crib, bearing against the rear wall of the crib. Devices are provided for securing the crib to the side walls of the crib as well as for strapping the crib to the parental bed. The free-standing embodiment is designed to collapse for storage and transport.

63 Claims, 8 Drawing Sheets

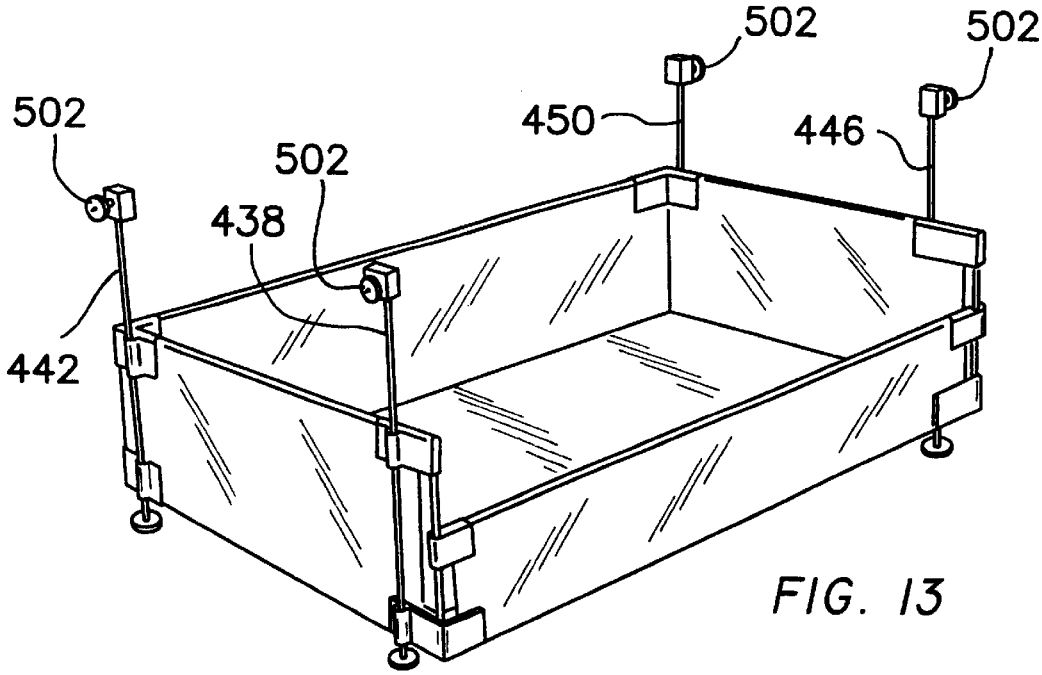
FIG. 13
FIG. 14
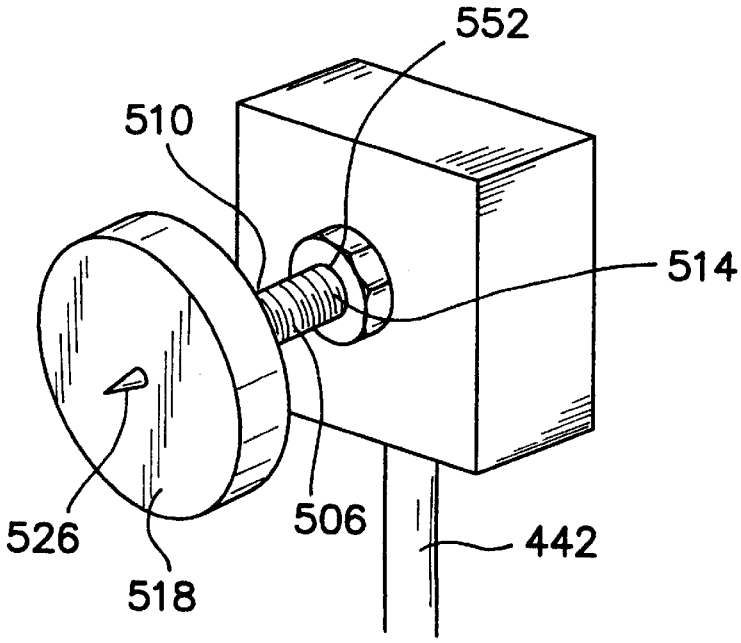

ADJUSTABLE CO-SLEEPER NEST

FIELD OF THE INVENTION

The instant invention relates to the field of convertible units for use with babies and very young children; in particular to units which may be easily converted to a crib or child's bed-side sleeping enclosure, hereinafter referred to for convenience as a "co-sleeper", that attaches securely to the parents' bed. The invention also includes a stand-alone unit for use with existing cribs.

BACKGROUND OF THE INVENTION

Furniture and fixtures for use by babies and small children often presents a problem for parents with limited living space. For this reason it is desirable that such furniture serve more than one purpose. A bedside co-sleeper is very useful for an infant or very young child as it prevents a parent from having to get out of bed to deal with a child requiring minor attention or comforting. If the co-sleeper can then be put to other uses, the parents will save both space and the cost of other furniture. Various examples of such multi-purpose children's furniture have been patented and sold.

In U.S. Pat. No. 5,349,709, issued to Cheng teaches a folding combination playpen and baby bed having an elevated floorboard. U.S. Pat. No. 5,339,470, issued to Shamie discloses a combination foldable playpen and dressing/changing table. Mariol adds an upper level to a playpen to provide a bassinet. The short legs of the upper level are inserted into openings in the top of the vertical supports of the playpen. (U.S. Pat. No. 5,553,336). U.S. Pat. No. 2,632,186, issued to Berk et al. discloses a portable combination crib and playpen. Saldana teaches a unit designed for home and travel that may be used as a support for a playpen, bassinet or baby chair (U.S. Pat. No. 2,691,176).

Beside cribs that attached to the parents' bed were known at the turn of the century (U.S. Pat. Nos. 5,548,005; 620,069; 1,138,451; 1,283,169; 1,267,244) but fell out of favor for many years. Recently there has been a resurgence in the practice of having babies adjacent the parents' bed. Such bed-side devices are taught in U.S. Pat. No. 5,172,435 to Griffin et al.; U.S. Pat. No. 5,148,561 to Tharalson et al; and U.S. Pat. No. 5,293,655 to Van Winkle et al.

It is an objective of the present invention to provide a crib that can be adapted for use as a baby co-sleeper. It is a further objective of the invention to provide a stand-alone unit that can be used to convert an existing crib to a co-sleeper. It is still a further objective of the present invention that the unit provide a means for adjusting the height of the co-sleeper unit within the crib structure so as to be adaptable for use with platform-style beds that are typically lower than conventional beds. Finally, it is an objective of the invention that the stand-alone unit be readily collapsible for transport and storage. Other features and advantages of the invention will be seen from the following description and drawings.

SUMMARY OF THE INVENTION

The present invention addresses all of the deficiencies of prior art convertible co-sleeper inventions and satisfies all of the objectives described above.

A crib convertibly adapted for use as a co-sleeper providing the desired features may be constructed from the following components. A first rigid enclosure with an open top, a floor, a front wall, and at least one surrounding wall is provided. The front wall is removably mounted to the crib and the enclosure is of a first predetermined height. A second enclosure sized to fit substantially within the first enclosure and having an open top, a bottom and at least one surrounding wall is provided. Means are provided for adjustably supporting the second enclosure within the first enclosure at at least one predetermined distance from the top of the first enclosure. A securing strap assembly for securing the crib to a parental bed is provided. When the front wall is removed from the crib, the second enclosure is supported by the supporting means, the securing strap assembly is properly positioned and the crib is secured to the parental bed the crib will serve as a co-sleeper.

In a variant of the invention, a crib convertibly adapted for use as a co-sleeper may be constructed from the following components. A rigid first enclosure having an open top, a floor, a front wall, a back wall, a first side wall and a second side wall is provided. The front wall is removably mounted to the crib and the first enclosure is of a first predetermined height. A second enclosure having an open top, a floor, a front, a back, a first side and a second side is provided.

First, second, third and fourth mounting rails, each of the rails having a first end and a second end are provided. The first mounting rail is affixed at its first end and its second end to the first side wall adjacent the front wall. The second mounting rail is affixed at its first end and its second end to the first side wall adjacent the back wall. The third mounting rail is affixed at its first end and its second end to the second side wall adjacent the front wall. The fourth mounting rail is affixed at its first end and its second end to the second side wall adjacent the back wall. Means are provided for adjustably mounting the second enclosure to the first, second, third and fourth mounting rails within the first enclosure at at least one predetermined distance from the top of the first enclosure. A securing strap assembly for securing the crib to a parental bed is provided. When the front wall is removed from the crib, the second enclosure is mounted within the first enclosure, the securing strap assembly is properly positioned and the crib is secured to the parental bed the crib will serve as a co-sleeper.

In a further variant of the invention, the back, first side and second side of the second enclosure are of a second predetermined height and the front of the second enclosure is of a third predetermined height, less than the second predetermined height.

In still a further variant of the invention, the first side and the second side of the second enclosure extend past a front edge of the first side wall and a front edge of the second side wall, respectively, for a second predetermined distance.

In yet a further variant, the means for adjustably mounting the second enclosure to the first, second, third and fourth mounting rails includes first, second, third and fourth locking guide tube assemblies. Each of the locking assemblies includes a length of rigid tubing. The tubing is sized and shaped to fit slidably over one the first, second, third and fourth mounting rails. Means for attaching the locking assembly to the second enclosure, and means for releasably securing the locking assembly to one of the mounting rails are provided.

The first locking guide assembly is attached to the second enclosure at an intersection of a front edge and a top edge of the first side. The second locking guide assembly is attached to the second enclosure at an intersection of a back edge and the top edge of the first side. The third locking guide assembly is attached to the second enclosure at an intersection of a front edge and a top edge of the second side. The fourth locking guide assembly is attached to the second enclosure at an intersection of a back edge and the top edge of the second side.

In still a further variant of the invention, the means for adjustably mounting the second enclosure to the first, second, third and fourth mounting rails includes first, second, third and fourth guide tube assemblies. Each of the guide tube assemblies includes a length of rigid tubing. The tubing is sized and shaped to fit slidably over one the first, second, third and fourth mounting rails. Means are provided for attaching the guide tube assembly to the second enclosure. The first guide tube assembly is attached to the second enclosure at an intersection of the front edge and a bottom edge of the first side. The second guide tube assembly is attached to the second enclosure at an intersection of the back edge and the bottom edge of the first side. The third guide tube assembly is attached to the second enclosure at an intersection of the front edge and a bottom edge of the second side. The fourth guide tube assembly is attached to the second enclosure at an intersection of the back edge and the bottom edge of the second side.

In yet a further variant of the invention, the means for releasably securing the locking guide tube assembly to one of the mounting rails includes a locking lever. The locking lever includes a handle portion and extends to a pivot portion and further extends to a cam portion. An orifice in the rigid tubing of the locking guide tube assembly is provided. The orifice is sized, shaped, and located to permit the cam portion of the locking lever to bear upon one of the first, second, third and fourth mounting rails.

A pivot mounting is provided. The pivot mounting is affixed adjacent the orifice in the rigid tubing and is sized, shaped, and located to permit pivotal mounting of the pivot portion of the locking lever. A pivot pin is provided. The pin pivotally secures the locking lever to the pivot mounting so that the locking lever will secure the locking guide tube assembly to the mounting rail in a first position and permit the mounting rail to slide within the rigid tubing of the locking guide tube assembly in a second position.

In still a further variant, the means for releasably securing the locking guide tube assembly to one of the mounting rails includes a series of orifices. The orifices are spaced along a length of each the first, second, third and fourth mounting rails. A plunger pin is provided. The plunger pin has a first end and a second end and has an operating knob at the first end and an engaging end at the second end. The engaging end is sized and shaped to fit slidably within one of the orifices in the mounting rails. A plunger pin housing is provided. The housing is affixed to the locking guide tube assembly and is sized, shaped and located to position the plunger pin orthogonal to the mounting rail so that the plunger pin will engage the orifices in the mounting rail.

A return spring is provided. The return spring is located within the plunger pin housing and is sized, shaped and located to cause the plunger pin to be urged toward the mounting rail. When the operating knob is withdrawn away from the mounting rail the plunger pin will be withdrawn from one of the orifices and the mounting rail will slide within the rigid tubing of the locking guide tube assembly. When the operating knob is released the plunger pin will engage one of the orifices in the mounting rail and the locking guide tube assembly will be secured to it.

In another variant, the means for releasably securing the locking guide tube assembly to one of the mounting rails includes at least two vertical slits. The slits extend from a lower end of the rigid tubing of the locking guide tube assembly upwardly for a first predetermined distance. An external tapered thread extends from the lower end of the rigid tubing upwardly for the first predetermined distance. A threaded collar is provided. The collar is sized, shaped, and located to threadedly engage the tapered thread of the rigid tubing. When the threaded collar is rotated in a first, tightening direction the vertical slits will permit the rigid tubing to bear frictionally against one of the first, second, third and fourth mounting rails. When the threaded collar is rotated in a second, loosening direction the vertical slits will permit the rigid tubing to slide over one of the first, second, third and fourth mounting rails, permitting vertical adjustment of the second enclosure.

In still another variant of the invention, the securing strap assembly for securing the crib to a parental bed further includes a strap member of a length greater than twice the width of the parental bed having a first end and a second end. A resistance plate member is provided that has at least two slots vertically aligned and centrally located through which the strap member is threaded such that the first end and the second end are substantially equidistant from the plate member. A strap member receiving means is fixedly attached to the first side wall and second side wall of the crib. Attachment cooperation means are slidably engaged near the first end and near the second end of the strap member for reversible connection to the strap member receiving means. Means for adjusting a length of the strap member and fixedly tightening it after connecting the attachment cooperation means to the strap member receiving means are provided. The strap member is properly positioned when located under a mattress of the parental bed and held in place by the resistance plate member located vertically at a side of the parental bed opposite placement of the crib and the strap member is tightened so the crib is held fast to the parental bed.

In yet another variant, the securing strap assembly for securing the crib to a parental bed includes first and second guide slots. The guide slots are sized, shaped and located upon the first and second side walls of the crib to constrain the strap member adjacent its first end and its second end, thereby more securely holding the crib to the parental bed.

In yet a further variant of the invention, a crib convertibly adapted for use as a co-sleeper includes a rigid first enclosure. The first enclosure has an open top, a floor, a front wall, a back wall, a first side wall and a second side wall. The front wall is removably mounted to the crib. The first enclosure is of the second predetermined height. A second enclosure is provided. The second enclosure has an open top, a floor, a front, a back, a first side and a second side. First, second, third and fourth mounting rails are provided. Each of the rails has a first end and a second end. The second and fourth mounting rails are located adjacent to and bear upon the back wall of the first enclosure.

A rear upper connecting rail is provided. The rear rail has a first end and a second end and is removably attached at its first end to the first end of the second mounting rail and removably attached at its second end to the first end of the fourth mounting rail. A first side upper connecting rail is provided. The first side rail has a first end and a second end and is removably attached at its first end to the first end of the second mounting rail and removably attached at its second end to the first end of the first mounting rail. A second side upper connecting rail is provided. The second side rail has a first end and a second end and is removably attached at its first end to the first end of the fourth mounting rail and removably attached at its second end to the first end of the third mounting rail.

Four mounting feet are provided. Each of the feet is sized and shaped to attach to the second end of one of the first, second, third and fourth mounting rails and to grip frictionally the floor of the first enclosure. Means are provided for adjustably mounting the second enclosure to the first, second, third and fourth mounting rails within the first enclosure at at least one predetermined distance from the top of the first enclosure.

A securing strap assembly is provided for securing the crib to a parental bed. When the front wall is removed from the crib, the second enclosure is mounted within the first enclosure, the securing strap assembly is properly positioned and the crib is secured to the parental bed, the crib will serve as a co-sleeper.

In still a further variant, a crib convertibly adapted for use as a co-sleeper also includes at least one pair of tensioning devices. The tensioning devices have a threaded rod with a first end, a second end, and an attachment plate. The plate is orthogonaly mounted to the first end of the threaded rod. At least one pair of threaded orifices passing orthogonaly through at least two of the second and fourth mounting rails and the first and third mounting rails is provided. The orifices are sized, shaped, and located to receive threadedly the second end of the threaded rods of the tensioning devices such that the threaded rods are collinear. When the threaded rods of the tensioning devices are rotated outwardly from two of the second and fourth mounting rails and the first and third mounting rails, the attachment plates will bear against the first side wall and the second side wall of the crib, thereby stabilizing the second enclosure within the crib.

In yet another variant, the tensioning device further includes a stabilizing point. The point is collinear with the threaded rod and mounted orthogonaly to the attachment plate, thereby preventing movement of the second enclosure with respect to the crib.

In still a further variant of the invention, a second enclosure for use with an existing crib is provided, along with a securing strap assembly for securing the crib to a parental bed. Mounting rails for the second enclosure are secured to the first and second side walls of the crib.

In yet another variation, for use with an existing crib, mounting rails for the second enclosure are free-standing and are removably attached together with a rear upper connecting rail, a first side upper connecting rail and a second side upper connecting rail. The second and fourth mounting rails are located adjacent to and bear upon the back wall of the existing crib. A securing strap assembly for securing the crib to the parental bed is also provided. In still another variant, at least one pair of tensioning devices is provided. In still another variation, tensioning devices bear upon first and second side walls of the existing crib and serve to stabilize the second enclosure within the existing crib. In a final variant, the tensioning devices include stabilizing points to prevent movement of the stabilizing devices with respect to the crib.

DESCRIPTION OF THE DRAWINGS

FIG. 13 is a perspective view of a third embodiment of a second enclosure illustrating tensioning devices for attachment to a crib;

FIG. 14 is a detailed perspective view of the tensioning device illustrating a stabilizing point;

DETAILED DESCRIPTION OF THE PREFERRED EMBODIMENT

Figure 1:
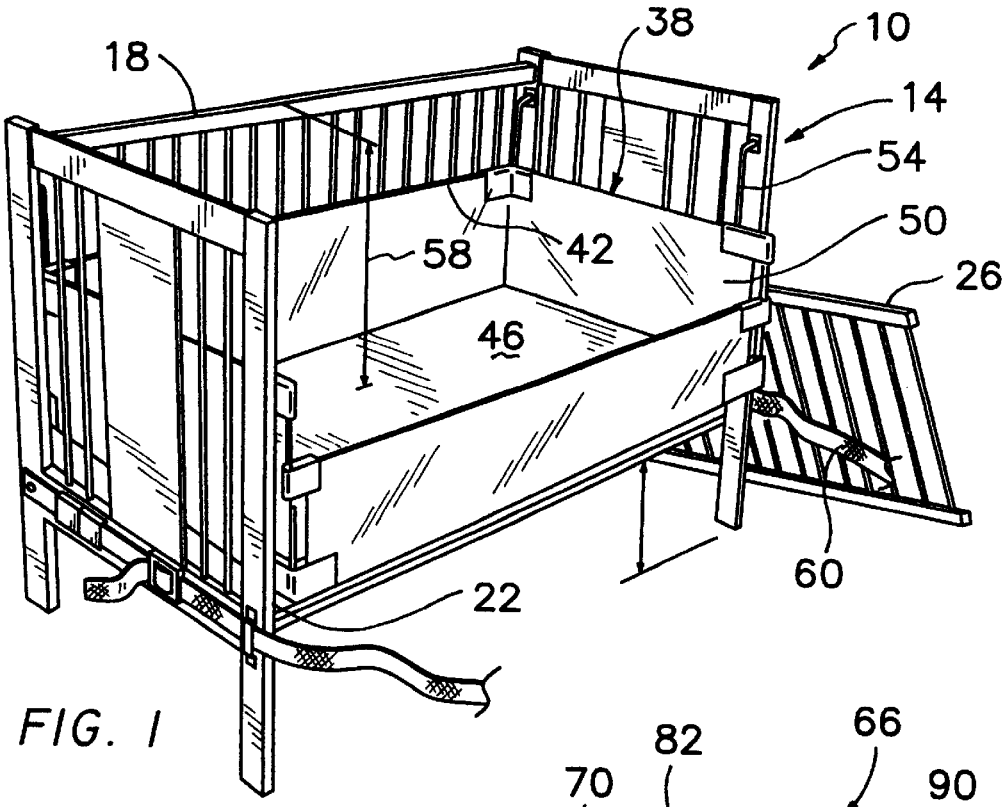
FIG. 1 is a perspective view of a first embodiment of the invention illustrating a crib with removable front wall with a co-sleeper nest installed.

FIG. 1 illustrates a crib convertibly adapted for use as a co-sleeper 10 providing the desired features. The crib 10 may be constructed from the following components. A first rigid enclosure 14 with an open top 18, a floor 22, a front wall 26, and at least one surrounding wall 30 is provided. The front wall 26 is removably mounted to the crib 10 and the first enclosure 14 is of a first predetermined height 34. A second enclosure 38 sized to fit substantially within the first enclosure 14 and having an open top 42, a bottom 46 and at least one surrounding wall 50 is provided. Means 54 are provided for adjustably supporting the second enclosure 38 within the first enclosure 14 at at least one predetermined distance 58 from the top 18 of the first enclosure 14. A securing strap assembly 60 for securing the crib 10 to a parental bed (not shown) is provided. When the front wall 26 is removed from the crib 10, the second enclosure 38 is supported by the supporting means 54, the securing strap assembly 60 is properly positioned and the crib 10 is secured to the parental bed 62 the crib 10 will serve as a co-sleeper.

Figure 2:
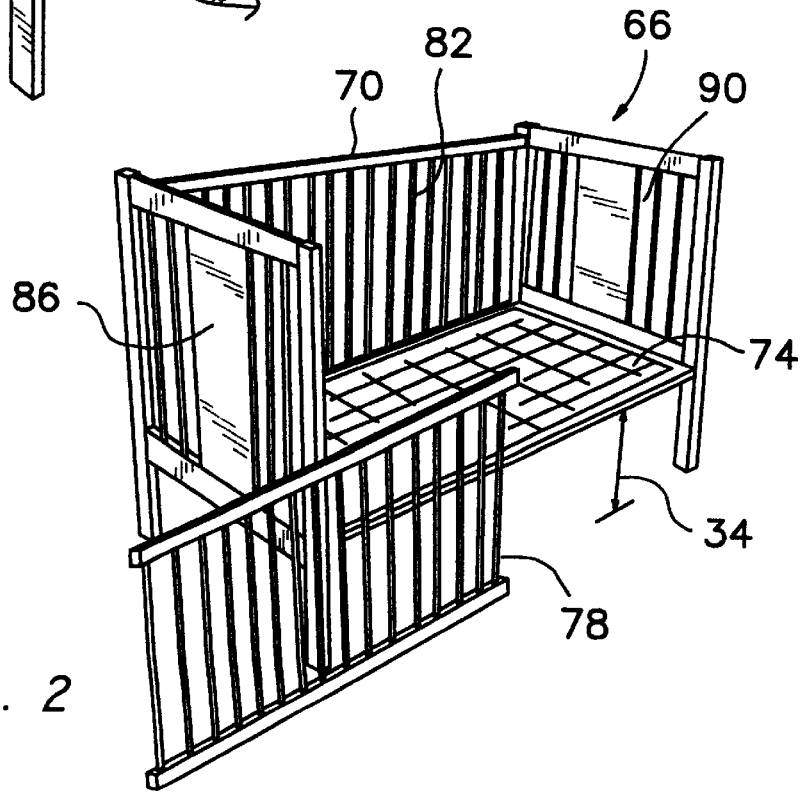
FIG. 2 is a perspective view of a first enclosure crib with a removable front wall used as part of a second embodiment of the invention.
Figure 3:
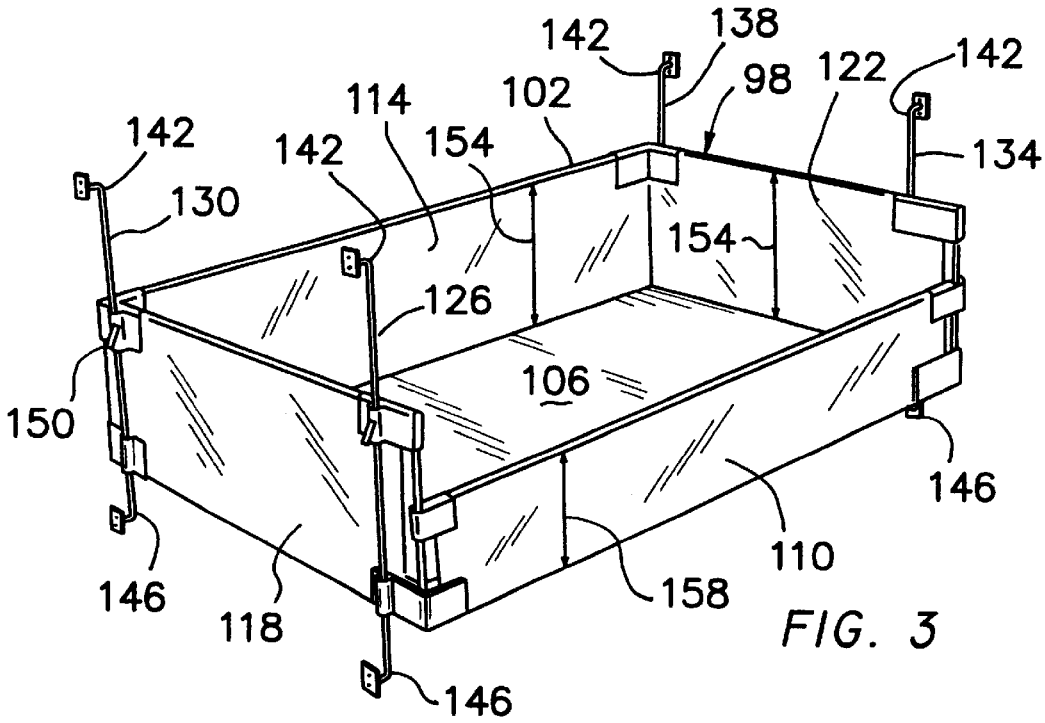
FIG. 3 is a perspective view of a first embodiment of second enclosure used with the FIG. 2 crib in the second embodiment of the invention.
Figure 4:
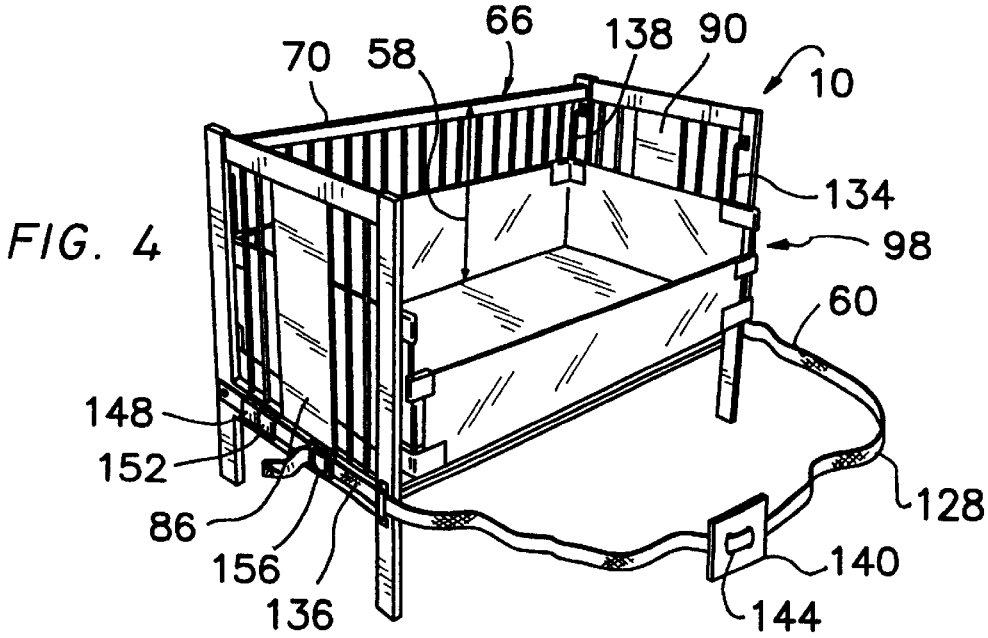
FIG. 4 is a perspective view of the second embodiment illustrating a securing strap assembly for attachment to a parental bed.

In a variant of the invention, illustrated in FIGS. 2–4, a crib convertibly adapted for use as a co-sleeper 10 may be constructed from the following components. A rigid first enclosure 66 having an open top 70, a floor 74, a front wall 78, a back wall 82, a first side wall 86 and a second side wall 90 is provided. The front wall 78 is removably mounted to the crib 10 and the first enclosure 66 is of a first predetermined height 34. As illustrated in FIG. 3, a second enclosure 98 having an open top 102, a floor 106, a front 110, a back 114, a first side 118 and a second side 122 is provided.

First 126, second 130, third 134 and fourth 138 mounting rails, each of the rails 126, 130, 134, 138 having a first end 142 and a second end 146 are provided. The first mounting rail 126 is affixed at its first end 142 and its second end 146 to the first side wall 86 adjacent the front wall 78. The second mounting rail 130 is affixed at its first end 142 and its second end 146 to the first side wall 86 adjacent the back wall 82. The third mounting rail 134 is affixed at its first end 142 and its second end 146 to the second side wall 90 adjacent the front wall 78. The fourth mounting rail 138 is affixed at its first end 142 and its second end (not shown) to the second side wall 90 adjacent the back wall 82. As illustrated in FIGS. 3 and 4, means 150 are provided for adjustably mounting the second enclosure 98 to the first 126, second 130, third 134 and fourth 138 mounting rails within the first enclosure 66 at at least one predetermined distance 58 from the top 70 of the first enclosure 66. A securing strap assembly 60 for securing the crib 10 to a parental bed (not shown) is provided. When the front wall 78 is removed from the crib 10, the second enclosure 98 is mounted within the first enclosure 66, the securing strap assembly 60 is properly positioned and the crib 10 is secured to the parental bed the crib 10 will serve as a co-sleeper.

In a further variant of the invention, as illustrated in FIG. 3, the back 114, first side 118 and second side 122 of the second enclosure 98 are of a second predetermined height 154 and the front 110 of the second enclosure 98 is of a third predetermined height 158, less than the second predetermined height 154.

Figure 5:
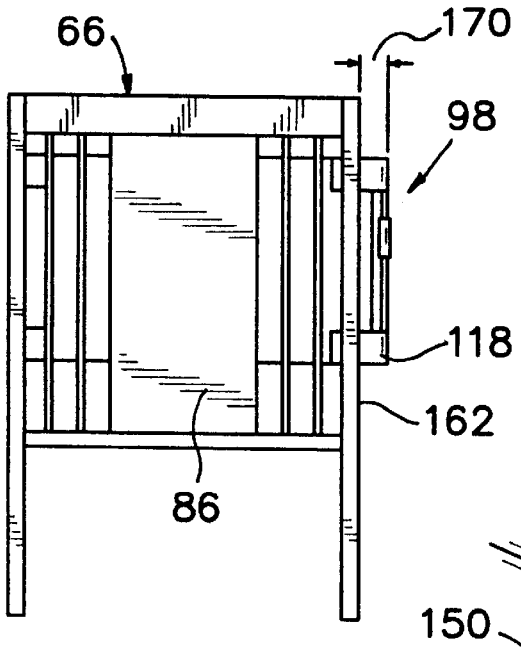
FIG. 5 is a side elevational view of the FIG. 4 embodiment illustrating the projection of the second enclosure past a front of the first enclosure.

In still a further variant of the invention, as illustrated in FIG. 5, the first side 118 and the second side 122 of the second enclosure 98 extend past a front edge 162 of the first side wall 86 and a front edge 166 of the second side wall 90, respectively, for a second predetermined distance 170.

Figure 6:
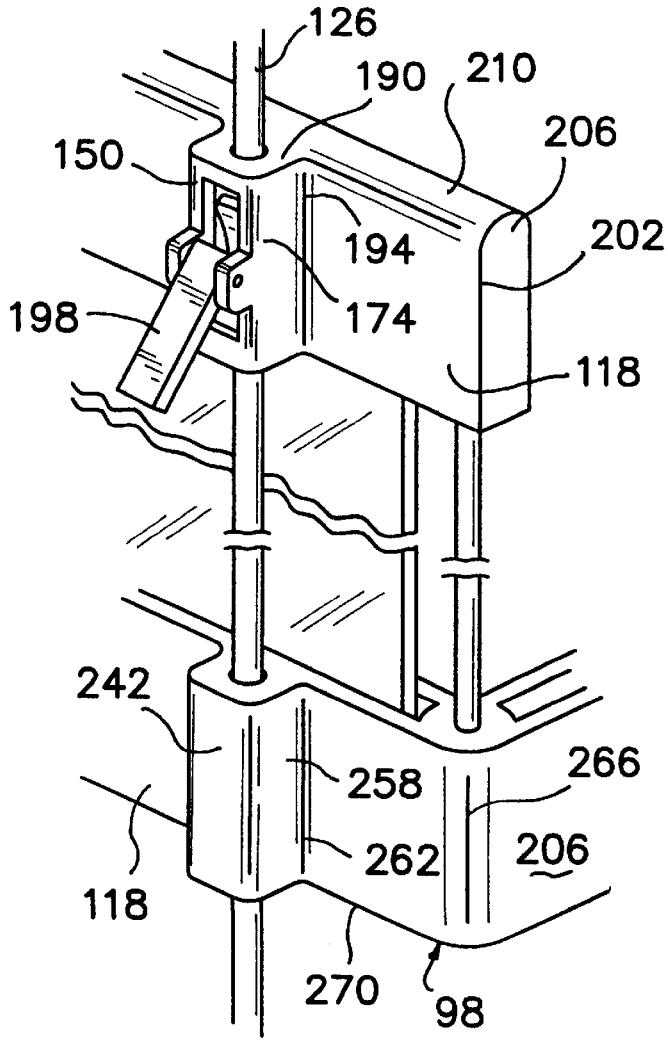
FIG. 6 is a detailed perspective view of a first embodiment of a locking guide tube assembly and a guide tube assembly.
Figure 7:
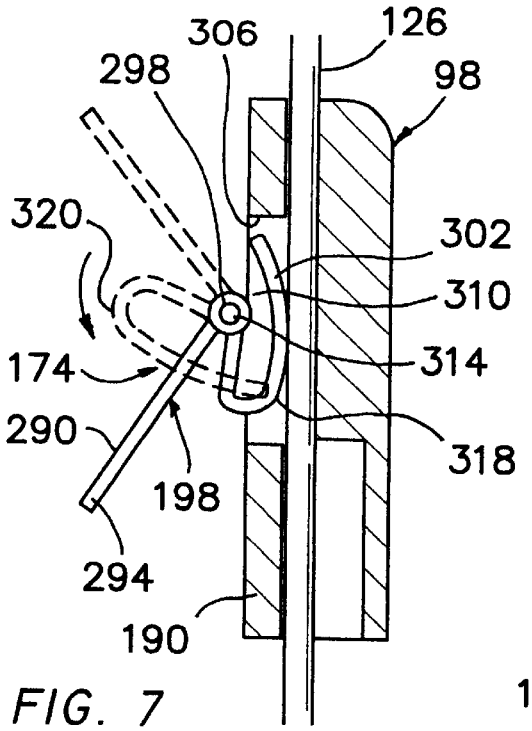
FIG. 7 is a detailed cross-sectional side view of the first embodiment of the locking guide tube assembly.

In yet a further variant, as illustrated in FIGS. 6 and 7, the means 150 for adjustably mounting the second enclosure 98 to the first 126, second 130, third 134 and fourth 138 mounting rails includes first 174, second (not shown), third (not shown) and fourth (not shown) locking guide tube assemblies. Each of the locking assemblies 174, (not shown) includes a length of rigid tubing 190. The tubing 190 is sized and shaped to fit slidably over one the first 126, second 130, third 134 and fourth 138 mounting rails. Means 194 for attaching the locking assembly 174 to the second enclosure 98, and means 198 for releasably securing the locking assembly 174 to one of the mounting rails 126, 130, 134, 138 are provided.

The first locking guide assembly 174 is attached to the second enclosure 98 adjacent an intersection 202 of a front edge 206 and a top edge 210 of the first side 118. The second locking guide assembly is attached to the second enclosure 98 adjacent an intersection (not shown) of a back edge (not shown) and the top edge 210 of the first side 118. The third locking guide assembly is attached to the second enclosure 98 at an intersection (not shown) of a front edge (not shown) and a top edge (not shown) of the second side 122. The fourth locking guide assembly is attached to the second enclosure 98 at an intersection (not shown) of a back edge (not shown) and the top edge (not shown) of the second side 122.

In still a further variant of the invention, as illustrated in FIG. 6, the means 150 for adjustably mounting the second enclosure 98 to the first 126, second 130, third 134 and fourth 138 mounting rails includes first 242, second (not shown), third (not shown) and fourth (not shown) guide tube assemblies. Each of the guide tube assemblies 242, (not shown) includes a length of rigid tubing 258. The tubing 258 is sized and shaped to fit slidably over one the first 126, second 130, third 134 and fourth 138 mounting rails. Means 262 are provided for attaching the guide tube assembly 242 to the second enclosure 98. The first guide tube assembly 242 is attached to the second enclosure 98 adjacent an intersection 266 of the front edge 206 and a bottom edge 270 of the first side 118. The second guide tube assembly is attached to the second enclosure 98 adjacent an intersection (not shown) of the back edge (not shown) and the bottom edge 270 of the first side 118. The third guide tube assembly is attached to the second enclosure 98 adjacent an intersection (not shown) of the front edge (not shown) and a bottom edge (not shown) of the second side 122. The fourth guide tube assembly is attached to the second enclosure 98 adjacent an intersection (not shown) of the back edge (not shown) and the bottom edge of the second side 122.

In yet a further variant of the invention, as illustrated in FIG. 7, the means 198 for releasably securing the locking guide tube assembly 174 to one of the mounting rails 126, 130, 134, 138 includes a locking lever 290. The locking lever 290 includes a handle portion 294 and extends to a pivot portion 298 and further extends to a cam portion 302. An orifice 306 in the rigid tubing 190 of the locking guide tube assembly 174 is provided. The orifice 306 is sized, shaped, and located to permit the cam portion 302 of the locking lever 290 to bear upon one of the first 126, second 130, third 134 and fourth 138 mounting rails.

A pivot mounting 310 is provided. The pivot mounting 310 is affixed adjacent the orifice 306 in the rigid tubing 190 and is sized, shaped, and located to permit pivotal mounting of the pivot portion 298 of the locking lever 290. A pivot pin 314 is provided. The pin 314 pivotally secures the locking lever 290 to the pivot mounting 310 so that the locking lever 290 will secure the locking guide tube assembly 174 to the mounting rail 126, 130, 134, 138 in a first position 318 and permit the mounting rail 126, 130, 134, 138 to slide within the rigid tubing 190 of the locking guide tube assembly 174 in a second position 318.

Figure 8:
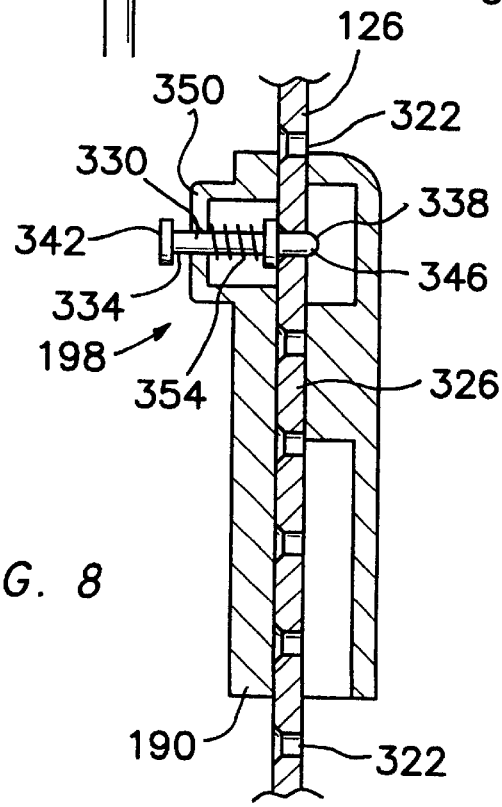
FIG. 8 is a detailed cross-sectional side view of the second embodiment of the locking guide tube assembly.

In still a further variant, as illustrated in FIG. 8, the means for releasably securing the locking guide tube assembly 174 to one of the mounting rails 126, 130, 134, 138 includes a series of orifices 322. The orifices 322 are spaced along a length 326 of each the first 126, second 130, third 134 and fourth 138 mounting rails. A plunger pin 330 is provided. The plunger pin 330 has a first end 334 and a second end 338 and has an operating knob 342 at the first end 334 and an engaging end 346 at the second end 338. The engaging end 346 is sized and shaped to fit slidably within one of the orifices 322 in the mounting rails 126, 130, 134, 138. A plunger pin housing 350 is provided. The housing 350 is affixed to the locking guide tube assembly 174 and is sized, shaped and located to position the plunger pin 330 orthogonal to the mounting rail 126, 130, 134, 138 so that the plunger pin 330 will engage the orifices 322 in the mounting rail 126, 130, 134, 138.

A return spring 354 is provided. The return spring 354 is located within the plunger pin housing 350 and is sized, shaped and located to cause the plunger pin 330 to be urged toward the mounting rail 126, 130, 134, 138. When the operating knob 342 is withdrawn away from the mounting rail 126, 130, 134, 138 the plunger pin 330 will be withdrawn from one of the orifices 322 and the mounting rail 126, 130, 134, 138 will slide within the rigid tubing 190 of the locking guide tube assembly 174. When the operating knob 342 is released the plunger pin 330 will engage one of the orifices 322 in the mounting rail 126, 130, 134, 138 and the locking guide tube assembly 174 will be secured to it.

Figure 9:
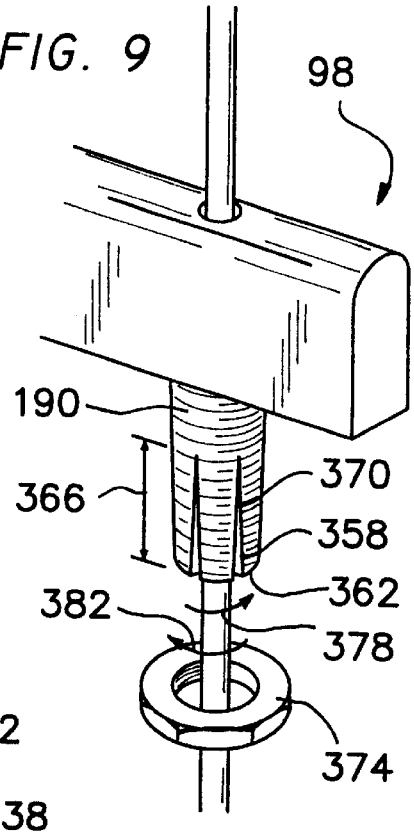
FIG. 9 is a detailed cross-sectional side view of the third embodiment of the locking guide tube assembly.

In another variant, as illustrated in FIG. 9, the means for releasably securing the locking guide tube assembly 174 to one of the mounting rails 126, 130, 134, 138 includes at least two vertical slits 358. The slits 358 extend from a lower end 362 of the rigid tubing 190 of the locking guide tube assembly 174 upwardly for a first predetermined distance 366. An external tapered thread 370 extends from the lower end 362 of the rigid tubing 190 upwardly for the first predetermined distance 366. A threaded collar 374 is provided. The collar 374 is sized, shaped, and located to threadedly engage the tapered thread 370 of the rigid tubing 190. When the threaded collar 374 is rotated in a first 378, tightening direction the vertical slits 358 will permit the rigid tubing 190 to bear frictionally against one of the first 126, second 130, third 134 and fourth 138 mounting rails. When the threaded collar 374 is rotated in a second 382, loosening direction the vertical slits 358 will permit the rigid tubing 190 to slide over one of the first 126, second 130, third 134 and fourth 138 mounting rails, permitting vertical adjustment of the second enclosure 98.

Figure 10:
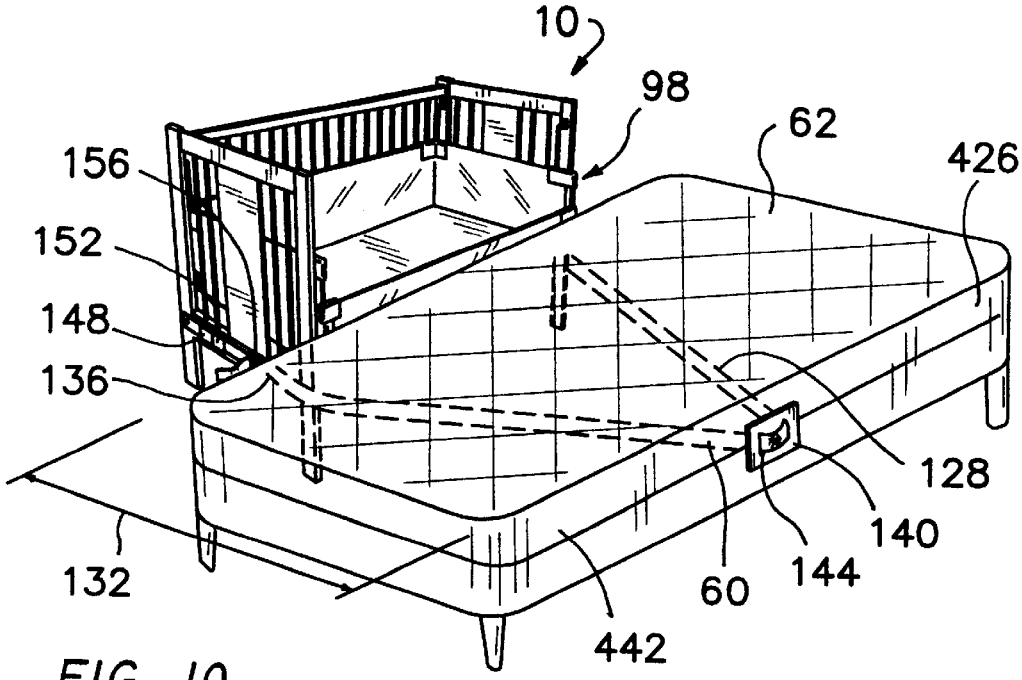
FIG. 10 is a perspective view of the second embodiment attached to a parental bed using the securing strap assembly.
Figure 11:
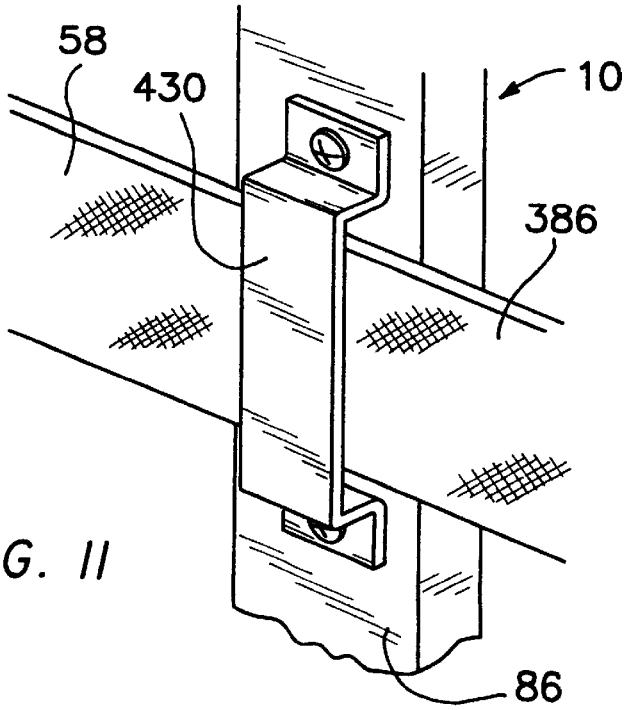
FIG. 11 is a detailed perspective view of a guide slot assembly attached to a side of the crib.

In still another variant of the invention, as illustrated in FIGS. 4, 10 and 11, the securing strap assembly 60 for securing the crib 10 to a parental bed 62 further includes a strap member 128 of a length greater than twice a width 132 of the parental bed 62 having a first end 136 and a second end (not shown). A resistance plate member 140 is provided that has at least two slots 144 vertically aligned and centrally located through which the strap member 128 is threaded such that the first end 136 and the second end are substantially equidistant from the plate member 140. A strap member receiving means 148 is fixedly attached to the first side wall 86 and second side wall 90 of the crib 10. Attachment cooperation means 152 are slidably engaged near the first end 136 and near the second end of the strap member 128 for reversible connection to the strap member receiving means 148. Means 156 for adjusting a length of the strap member 128 and fixedly tightening it after connecting the attachment cooperation means 152 to the strap member receiving means 148 are provided. The strap member 128 is properly positioned when located under a mattress 422 of the parental bed 62 and held in place by the resistance plate member 140 located vertically at a side 426 of the parental bed 62 opposite placement of the crib 10 and the strap member 128 is tightened so the crib 10 is held fast to the parental bed 62.

In yet another variant, as illustrated in FIG. 11, the securing strap assembly 60 for securing the crib 10 to a parental bed 62 includes first 430 and second (not shown) guide slots. The guide slots 430 are sized, shaped and located upon the first 86 and second 90 side walls of the crib 10 to constrain the strap member 386 adjacent its first end 394 and its second end, thereby more securely holding the crib 10 to the parental bed 62.

Figure 12:
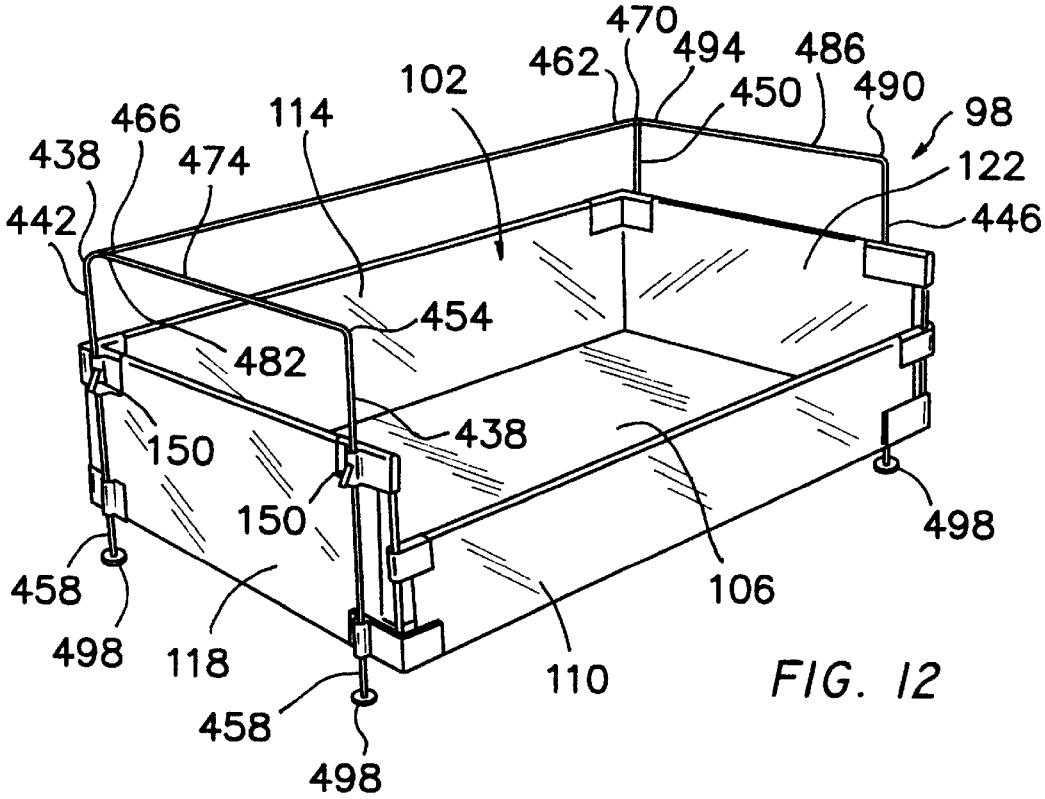
FIG. 12 is a perspective view of a second embodiment of a second enclosure illustrating supporting feet and rear and side connecting rails.
Figure 15:
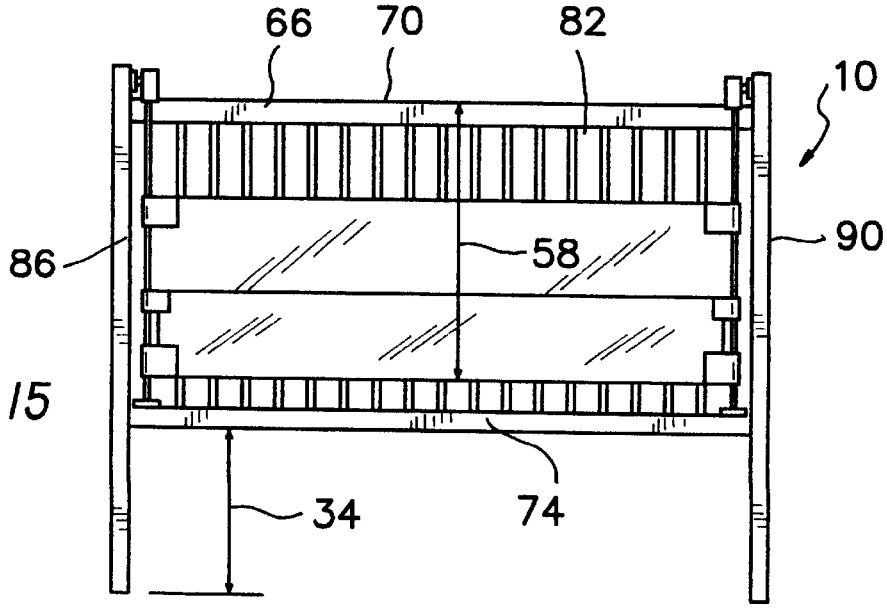
FIG. 15 is a front view of a third embodiment of the invention including the FIG. 13 second enclosure.

In yet a further variant of the invention, as illustrated in FIGS. 12 and 15, a crib convertibly adapted for use as a co-sleeper 10 includes a rigid first enclosure 66. The first enclosure 66 has an open top 70, a floor 74, a front wall (not shown), a back wall 82, a first side wall 86 and a second side wall 90. The front wall is removably mounted to the crib 10. The first enclosure 66 is of the first predetermined height 34. A second enclosure 98 is provided. The second enclosure 98 has an open top 102, a floor 106, a front 110, a back 114, a first side 118 and a second side 122. First 438, second 442, third 446 and fourth 450 mounting rails are provided. Each of the rails 438, 442, 446, 450 has a first end 454 and a second end 458. The second 442 and fourth 450 mounting rails are located adjacent to and bear upon the back wall 82 of the first enclosure 66.

A rear upper connecting rail 462 is provided. The rear rail 462 has a first end 466 and a second end 470 and is removably attached at its first end 462 to the first end 454 of the second mounting rail 442 and removably attached at its second end 466 to the first end 462 of the fourth mounting rail 450. A first side upper connecting rail 474 is provided. The first side rail 474 has a first end 478 and a second end 482 and is removably attached at its first end 478 to the first end 454 of the second mounting rail 442 and removably attached at its second end 482 to the first end 454 of the first mounting rail 438. A second side upper connecting rail 486 is provided. The second side rail 486 has a first end 490 and a second end 494 and is removably attached at its first end 490 to the first end 454 of the fourth mounting rail 450 and removably attached at its second end 494 to the first end 454 of the third mounting rail 446.

Four mounting feet 498 are provided. Each of the feet 498 is sized and shaped to attach to the second end 458 of one of the first 438, second 442, third 446 and fourth 450 mounting rails and to grip frictionally the floor 74 of the first enclosure 66. Means 150 are provided for adjustably mounting the second enclosure 98 to the first 438, second 442, third 446 and fourth 450 mounting rails within the first enclosure 66 at at least one predetermined distance 58 from the top 70 of the first enclosure 66.

As illustrated in FIG. 10, a securing strap assembly 60 is provided for securing the crib 10 to a parental bed 62. When the front wall 78 is removed from the crib 10, the second enclosure 100 is mounted within the first enclosure 66, the securing strap assembly 60 is properly positioned and the crib 10 is secured to the parental bed 62, the crib 10 will serve as a co-sleeper.

In still a further variant, as illustrated in FIGS. 2, 13 and 14, a crib convertibly adapted for use as a co-sleeper 10 also includes at least one pair of tensioning devices 502. The tensioning devices 502 have a threaded rod 506 with a first end 510, a second end 514, and an attachment plate 518. The plate 518 is orthogonaly mounted to the first end 510 of the threaded rod 506. At least one pair of threaded orifices 522 passing orthogonaly through at least two of the second 442 and fourth 450 mounting rails and the first 438 and third 446 mounting rails is provided. The orifices 522 are sized, shaped, and located to receive threadedly the second end 514 of the threaded rods 506 of the tensioning devices 502 such that the threaded rods 506 are collinear. When the threaded rods 506 of the tensioning devices 502 are rotated outwardly from two of the second 442 and fourth 450 mounting rails and the first 438 and third 446 mounting rails, the attachment plates 518 will bear against the first side wall 86 and the second side wall 90 of the crib 10, thereby stabilizing the second enclosure 98 within the crib 10.

In yet another variant, as illustrated in FIG. 14, the tensioning device 502 further includes a stabilizing point 526. The point 526 is collinear with the threaded rod 506 and mounted orthogonaly to the attachment plate 518, thereby preventing movement of the second enclosure 100 with respect to the crib 10.

Figure 16:
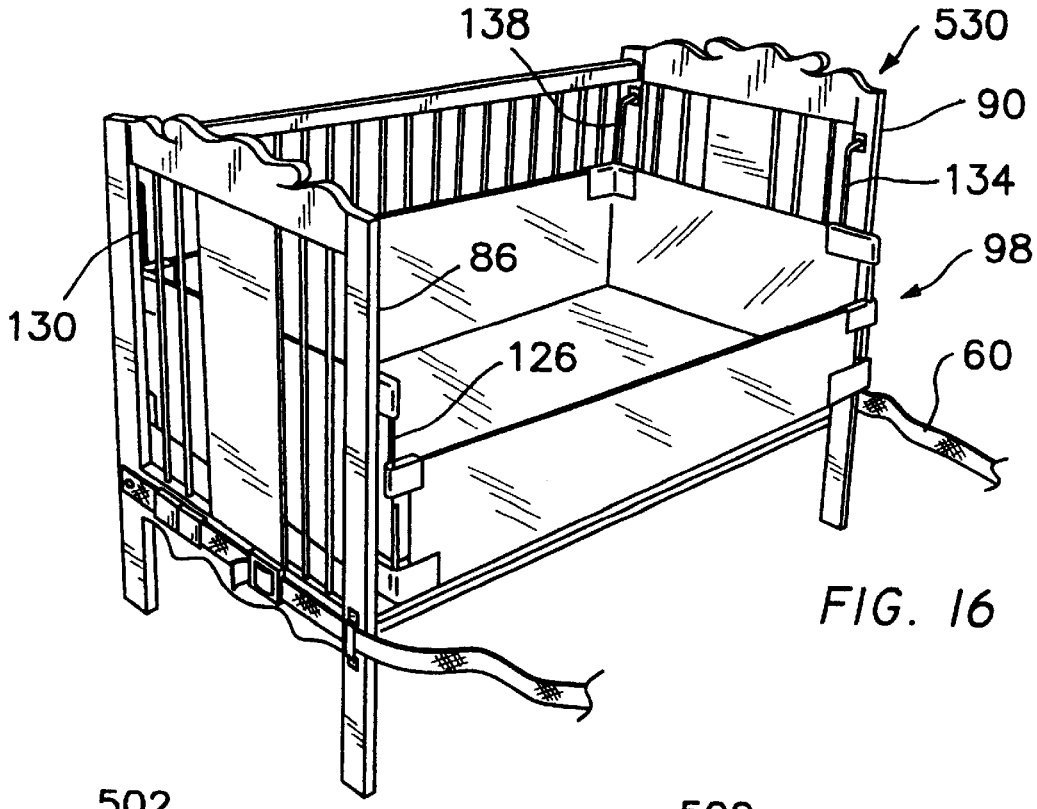
FIG. 16 is a perspective view of a fourth embodiment of the invention illustrating an existing crib with the FIG. 3 embodiment of the second enclosure attached.

In still a further variant of the invention, as illustrated in FIG. 16, a second enclosure 98 for use with an existing crib 530 is provided, along with a securing strap assembly 58 for securing the crib 530 to a parental bed 62. Mounting rails 126, 130, 134, 138 for the second enclosure 98 are secured to the first 86 and second 90 side walls of the crib 530.

Figure 17:
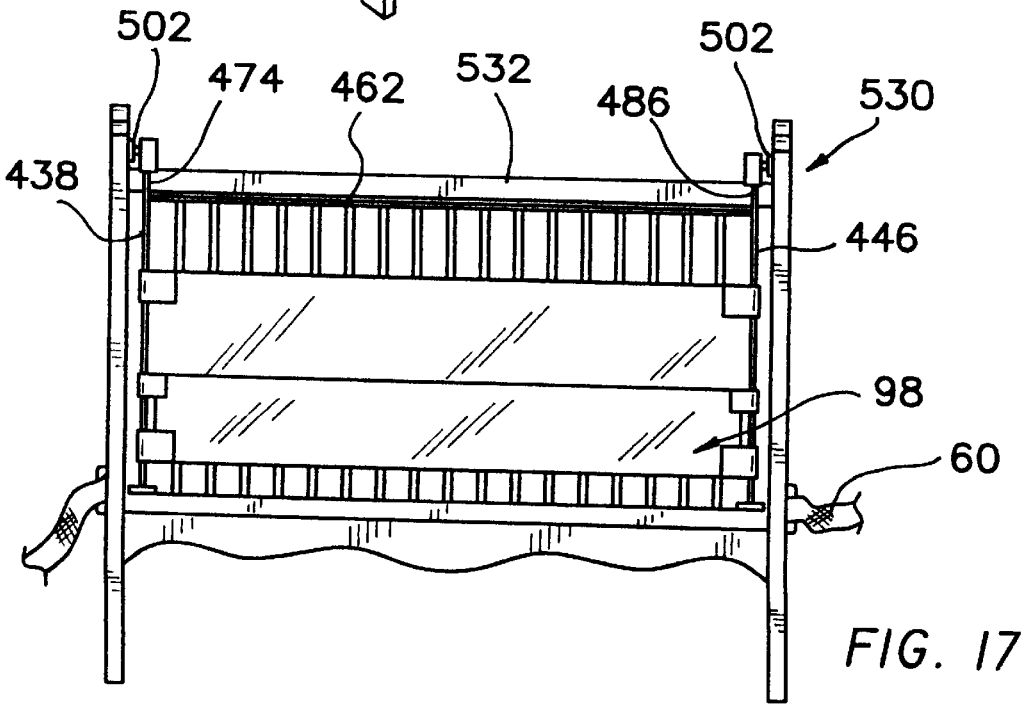
FIG. 17 is a perspective view of a fifth embodiment of the invention illustrating an existing crib with the FIG. 13 embodiment of the second enclosure attached.

In yet another variation, as illustrated in FIGS. 12 and 17, for use with an existing crib 530, mounting rails 438, 442, 446, 450 for the second enclosure 98 are free-standing and are removably attached together with a rear upper connecting rail 462, a first side upper connecting rail 474 and a second side upper connecting rail 486. The second 442 and fourth 450 mounting rails are located adjacent to and bear upon a back wall 532 of the existing crib 530. A securing strap assembly 58 for securing the crib 530 to the parental bed 62 is also provided. In still another variant, at least one pair of tensioning devices 502 is provided. In still another variation, tensioning devices 502 bear upon first 536 and second 540 side walls of the existing crib 530 and serve to stabilize the second enclosure 98 within the existing crib 530. In a final variant, as illustrated in FIG. 14 the tensioning devices 502 include stabilizing points 526 to prevent movement of the stabilizing devices 502 with respect to the crib 530.

What is claimed is:

1. A crib convertibly adapted for use as a co-sleeper comprising:

a first rigid enclosure having an open top, a floor, a front wall, and at least one surrounding wall;

said front wall being removably mounted to the crib;

said enclosure being of a first predetermined height;

a second enclosure, said second enclosure being sized to fit substantially within the first enclosure and having an open top, a bottom and at least one surrounding wall;

means for adjustably supporting a height of said second enclosure within the first enclosure at at least one predetermined distance from the top of the first enclosure;

a securing strap assembly for securing the crib to a parental bed; and wherein when the front wall is removed from the crib and the second enclosure is supported by the supporting means and the securing strap assembly is properly positioned and the crib is secured to the parental bed the crib may serve as a co-sleeper.

2. A crib convertibly adapted for use as a co-sleeper comprising:

a rigid first enclosure, said first enclosure having an open top, a floor, a front wall, a back wall, a first side wall and a second side wall;

said front wall being removably mounted to the crib;

said first enclosure being of a first predetermined height;

a second enclosure, said second enclosure having an open top, a floor, a front, a back, a first side and a second side;

first, second, third and fourth mounting rails, each of said rails having a first end and a second end;

said first mounting rail affixed at its first end and its second end to the first side wall adjacent the front wall;

said second mounting rail affixed at its first end and its second end to the first side wall adjacent the back wall;

said third mounting rail affixed at its first end and its second end to the second side wall adjacent the front wall;

said fourth mounting rail affixed at its first end and its second end to the second side wall adjacent the back wall;

means for adjustably mounting said second enclosure to said first, second, third and fourth mounting rails within said first enclosure at at least one predetermined distance from the top of the first enclosure;

a securing strap assembly for securing the crib to a parental bed; and wherein when the front wall is removed from the crib and the second enclosure is mounted within said first enclosure and the securing strap assembly is properly positioned and the crib is secured to the parental bed the crib will serve as a co-sleeper.

3. A crib convertibly adapted for use as a co-sleeper, as described in claim 2, wherein the back, first side and second side of the second enclosure are of a second predetermined height and the front of the second enclosure is of a third predetermined height, less than the second predetermined height.

4. A crib convertibly adapted for use as a co-sleeper, as described in claim 2, wherein the first side and the second side of the second enclosure extend past a front edge of the first side wall and a front edge the second side wall, respectively, for a second predetermined distance.

5. A crib convertibly adapted for use as a co-sleeper, as described in claim 2 wherein the means for adjustably mounting said second enclosure to said first, second, third and fourth mounting rails further comprises:

first, second, third and fourth locking guide tube assemblies, each of said locking assemblies including a length of rigid tubing, said tubing sized and shaped to fit slidably over one the first, second, third and fourth mounting rails, means for attaching the locking assembly to the second enclosure, and means for releasably securing the locking assembly to one of the mounting rails;

said first locking guide assembly attached to the second enclosure at an intersection of a front edge and a top edge of the first side;

said second locking guide assembly attached to the second enclosure at an intersection of a back edge and the top edge of the first side;

said third locking guide assembly attached to the second enclosure at an intersection of a front edge and a top edge of the second side; and said fourth locking guide assembly attached to the second enclosure at an intersection of a back edge and the top edge of the second side.

6. A crib convertibly adapted for use as a co-sleeper, as described in claim 5 wherein the means for adjustably mounting said second enclosure to said first, second, third and fourth mounting rails further comprises:

first, second, third and fourth guide tube assemblies, each of said guide tube assemblies including a length of rigid tubing, said tubing sized and shaped to fit slidably over one the first, second, third and fourth mounting rails and means for attaching the guide tube assembly to the second enclosure;

said first guide tube assembly attached to the second enclosure at an intersection of the front edge and a bottom edge of the first side;

said second guide tube assembly attached to the second enclosure at an intersection of the back edge and the bottom edge of the first side;

said third guide tube assembly attached to the second enclosure at an intersection of the front edge and a bottom edge of the second side; and said fourth guide tube assembly attached to the second enclosure at an intersection of the front edge and the bottom edge of the second side.

7. A crib convertibly adapted for use as a co-sleeper, as described in claim 5, wherein the means for releasably securing the locking guide tube assembly to one of the mounting rails further comprises:

a locking lever, said locking lever including a handle portion and extending to a pivot portion and further extending to a cam portion;

an orifice in the rigid tubing of the locking guide tube assembly, said orifice being sized, shaped, and disposed to permit the cam portion of the locking lever to bear upon one of the first, second, third and fourth mounting rails;

a pivot mounting, said pivot mounting affixed adjacent the orifice in the rigid tubing and being sized, shaped, and disposed to permit pivotal mounting of the pivot portion of the locking lever; and a pivot pin, said pin pivotally securing the locking lever to the pivot mounting such that the locking lever will secure the locking guide tube assembly to the mounting rail in a first position and permit the mounting rail to slide within the rigid tubing of the locking guide tube assembly in a second position.

8. A crib convertibly adapted for use as a co-sleeper, as described in claim 5, wherein the means for releasably securing the locking guide tube assembly to one of the mounting rails further comprises:

a series of orifices, said orifices spaced along a length of each the first, second, third and fourth mounting rails;

a plunger pin, said plunger pin having a first end and a second end and having an operating knob at said first end and an engaging end at said second end, said engaging end sized and shaped to fit slidably within one of the orifices in the mounting rails;

a plunger pin housing, said housing being affixed to the locking guide tube assembly and being sized, shaped and disposed to position the plunger pin orthogonal to the mounting rail so that the plunger pin will engage the orifices in the mounting rail;

a return spring, said return spring disposed within the plunger pin housing and being sized, shaped and disposed to cause the plunger pin to be urged toward the mounting rail; and whereby, when the operating knob is withdrawn away from the mounting rail the plunger pin will be withdrawn from one of the orifices and the mounting rail will slide within the rigid tube of the locking guide tube assembly and when the operating knob is released the plunger pin will engage one of the orifices in the mounting rail and the locking guide tube assembly will be secured thereto.

9. A crib convertibly adapted for use as a co-sleeper, as described in claim 5, wherein the means for releasably securing the locking guide tube assembly to one of the mounting rails further comprises:

at least two vertical slits, said slits extending from a lower end of the rigid tubing of the locking guide tube assembly upwardly for a first predetermined distance;

an external tapered thread, said thread extending from the lower end of said rigid tubing upwardly for said first predetermined distance;

a threaded collar, said collar being sized, shaped, and disposed to threadedly engage the tapered thread of the rigid tubing; and whereby, when the threaded collar is rotated in a first, tightening direction the vertical slits will permit the rigid tubing to bear frictionally against one of the first, second, third and fourth mounting rails and when the threaded collar is rotated in a second, loosening direction the vertical slits will permit the rigid tubing to slide over one of the first, second, third and fourth mounting rails, thereby permitting vertical adjustment of the second enclosure.

10. A crib convertibly adapted for use as a co-sleeper, as described in claim 2, wherein the securing strap assembly for securing the crib to a parental bed further comprises:

a strap member of a length greater than twice a width of the parental bed and having a first end and a second end;

a resistance plate member having at least two slots vertically aligned and centrally disposed through which the strap member is threaded such that the first end and the second end are substantially equidistant from the plate member;

strap member receiving means fixedly attached to the first side wall and second side wall of the crib;

attachment cooperation means slidably engaged near the first end and near the second end of the strap member for reversible connection to the strap member receiving means;

means for adjusting the length of the strap member and fixedly tightening same after connecting the attachment cooperation means to the strap member receiving means; and wherein the strap member is properly positioned when disposed under a mattress of the parental bed and held in place by the resistance plate member disposed vertically at the side of the parental bed opposite placement of the crib and the strap member is tightened so the crib is held fast to the parental bed.

11. A crib convertibly adapted for use as a co-sleeper, as described in claim 2, wherein the securing strap assembly for securing the crib to a parental bed further comprises:

first and second guide slots, said guide slots sized, shaped and disposed upon the first and second side walls of the crib to constrain the strap member adjacent its first end and its second end, thereby more securely holding the crib to the parental bed.

12. A crib convertibly adapted for use as a co-sleeper comprising:

a rigid first enclosure, said first enclosure having an open top, a floor, a front wall, a back wall, a first side wall and a second side wall;

said front wall being removably mounted to the crib;

said first enclosure being of a first predetermined height;

a second enclosure, said second enclosure having an open top, a floor, a front, a back, a first side and a second side;

first, second, third and fourth mounting rails, each of said rails having a first end and a second end;

said second and fourth mounting rails being disposed adjacent and bearing upon the back wall of the first enclosure;

a rear upper connecting rail, said rear rail having a first end and a second end and being removably attached at its first end to the first end of the second mounting rail and removably attached at its second end to the first end of the fourth mounting rail;

a first side upper connecting rail, said first side rail having a first end and a second end and being removably attached at its first end to the first end of the second mounting rail and removably attached at its second end to the first end of the first mounting rail;

a second side upper connecting rail, said second side rail having a first end and a second end and being removably attached at its first end to the first end of the fourth mounting rail and removably attached at its second end to the first end of the third mounting rail;

four mounting feet, each of said feet being sized and shaped to attach to the second end of one of the first, second, third and fourth mounting rails and to grip frictionally the floor of the first enclosure;

means for adjustably mounting said second enclosure to said first, second, third and fourth mounting rails within said first enclosure at at least one predetermined distance from the top of the first enclosure;

a securing strap assembly for securing the crib to a parental bed; and wherein when the front wall is removed from the crib and the second enclosure is mounted within said first enclosure and the securing strap assembly is properly positioned and the crib is secured to the parental bed the crib will serve as a co-sleeper.

13. A crib convertibly adapted for use as a co-sleeper, as described in claim 12, further comprising:

at least one pair of tensioning devices, said tensioning devices having a threaded rod, said rod having a first end and a second end, and an attachment plate, said plate being orthogonaly mounted to the first end of the threaded rod;

at least one pair of threaded orifices, said orifices passing orthogonaly through at least two of the second and fourth mounting rails and the first and third mounting rails, and being sized, shaped, and disposed to receive threadedly the second end of the threaded rods of the tensioning devices such that the threaded rods are collinear; and whereby, when the threaded rods of the tensioning devices are rotated outwardly from two of the second and fourth mounting rails and the first and third mounting rails the attachment plates will bear against the first side wall and the second side wall of the crib, thereby stabilizing the second enclosure within the crib.

14. A crib convertibly adapted for use as a co-sleeper, as described in claim 13, wherein the tensioning device further comprises a stabilizing point, said point being collinear with the threaded rod and mounted orthogonaly to the attachment plate, thereby preventing movement of the second enclosure with respect to the crib.

15. A crib convertibly adapted for use as a co-sleeper, as described in claim 12, wherein the back, first side and second side of the second enclosure are of a second predetermined height and the front of the second enclosure is of a third predetermined height, less than the second predetermined height.

16. A crib convertibly adapted for use as a co-sleeper, as described in claim 12, wherein the first side and the second side of the second enclosure extend past a front edge of the first side wall and a front edge the second side wall, respectively, for a second predetermined distance.

17. A crib convertibly adapted for use as a co-sleeper, as described in claim 12 wherein the means for adjustably mounting said second enclosure to said first, second, third and fourth mounting rails further comprises:

first, second, third and fourth locking guide tube assemblies, each of said locking assemblies including a length of rigid tubing, said tubing sized and shaped to fit slidably over one the first, second, third and fourth mounting rails, means for attaching the locking assembly to the second enclosure, and means for releasably securing the locking assembly to one of the mounting rails;

said first locking guide assembly attached to the second enclosure at an intersection of a front edge and a top edge of the first side;

said second locking guide assembly attached to the second enclosure at an intersection of a back edge and the top edge of the first side;

said third locking guide assembly attached to the second enclosure at an intersection of a front edge and a top edge of the second side; and said fourth locking guide assembly attached to the second enclosure at an intersection of a back edge and the top edge of the second side.

18. A crib convertibly adapted for use as a co-sleeper, as described in claim 17 wherein the means for adjustably mounting said second enclosure to said first, second, third and fourth mounting rails further comprises:

first, second, third and fourth guide tube assemblies, each of said guide tube assemblies including a length of rigid tubing, said tubing sized and shaped to fit slidably over one the first, second, third and fourth mounting rails and means for attaching the guide tube assembly to the second enclosure;

said first guide tube assembly attached to the second enclosure at an intersection of the front edge and a bottom edge of the first side;

said second guide tube assembly attached to the second enclosure at an intersection of the back edge and the bottom edge of the first side;

said third guide tube assembly attached to the second enclosure at an intersection of the front edge and a bottom edge of the second side; and said fourth guide tube assembly attached to the second enclosure at an intersection of the back edge and the bottom edge of the second side.

19. A crib convertibly adapted for use as a co-sleeper, as described in claim 17, wherein means for releasably securing the locking guide tube assembly to one of the mounting rails further comprises:

a locking lever, said locking lever including a handle portion and extending to a pivot portion and further extending to a cam portion;

an orifice in the rigid tubing of the locking guide tube assembly, said orifice being sized, shaped, and disposed to permit the cam portion of the locking lever to bear upon one of the first, second, third and fourth mounting rails;

a pivot mounting, said pivot mounting affixed adjacent the orifice in the rigid tubing and being sized, shaped, and disposed to permit pivotal mounting of the pivot portion of the locking lever, and a pivot pin, said pin pivotally securing the locking lever to the pivot mounting such that the locking lever will secure the locking guide tube assembly to the mounting rail in a first position and permit the mounting rail to slide within the rigid tubing of the locking guide rube assembly in a second position.

20. A crib convertibly adapted for use as a co-sleeper, as described in claim 17, wherein means for releasably securing the locking guide tube assembly to one of the mounting rails further comprises:

a series of orifices, said orifices spaced along a length of each the first, second, third and fourth mounting rails;

a plunger pin, said plunger pin having a first end and a second end and having an operating knob at said first end and an engaging end at said second end, said engaging end sized and shaped to fit slidably within one of the orifices in the mounting rails;

a plunger pin housing, said housing being affixed to the locking guide tube assembly and being sized, shaped and disposed to position the plunger pin orthogonal to the mounting rail so that the plunger pin will engage the orifices in the mounting rail;

a return spring, said return spring disposed within the plunger pin housing and being sized, shaped and disposed to cause the plunger pin to be urged toward the mounting rail; and whereby, when the operating knob is withdrawn away from the mounting rail the plunger pin will be withdrawn from one of the orifices and the mounting rail will slide within the rigid tubing of the locking guide tube assembly and when the operating knob is released the plunger pin will engage one of the orifices in the mounting rail and the locking guide tube assembly will be secured thereto.

21. A crib convertibly adapted for use as a co-sleeper, as described in claim 17, wherein means for releasably securing the locking guide tube assembly to one of the mounting rails further comprises:

at least two vertical slits, said slits extending from a lower end of the rigid tubing of the locking guide tube assembly upwardly for a first predetermined distance;

an external tapered thread, said thread extending from the lower end of said rigid tubing upwardly for said first predetermined distance;

a threaded collar, said collar being sized, shaped, and disposed to threadedly engage the tapered thread of the rigid tubing; and whereby, when the threaded collar is rotated in a first, tightening direction the vertical slits will permit the rigid tubing to bear frictionally against one of the first, second, third and fourth mounting rails and when the threaded collar is rotated in a second, loosening direction the vertical slits will permit the rigid tubing to slide over one of the first, second, third and fourth mounting rails, thereby permitting vertical adjustment of the second enclosure.

22. A second enclosure for use with a crib, said crib comprising a rigid first enclosure of a first predetermined height, said first enclosure having an open top, a floor, a front wall, a back wall, a first side wall and a second side wall, said front wall being removably mounted to the crib, said second enclosure further comprising:

an open top, a floor, a front, a back, a first side and a second side;

first, second, third and fourth mounting rails, each of said rails having a first end and a second end;

said first mounting rail affixed at its first end and its second end to the first side wall adjacent the front wall;

said second mounting rail affixed at its first end and its second end to the first side wall adjacent the back wall;

said third mounting rail affixed at its first end and its second end to the second side wall adjacent the front wall;

said fourth mounting rail affixed at its first end and its second end to the second side wall adjacent the back wall;

means for adjustably mounting said second enclosure to said first, second, third and fourth mounting rails within said first enclosure at at least one predetermined distance from the top of the first enclosure;

a securing strap assembly for securing the crib to a parental bed; and wherein, when the front wall is removed from the crib and the second enclosure is mounted within said first enclosure and the securing strap assembly is properly positioned and the crib is secured to the parental bed the crib will serve as a co-sleeper.

23. A second enclosure for use with a crib, as described in claim 22, wherein the back, first side and second side of the second enclosure are of a second predetermined height and the front of the second enclosure is of a third predetermined height, less than the second predetermined height.

24. A second enclosure for use with a crib, as described in claim 22, wherein the first side and the second side of the second enclosure extend past a front edge of the first side wall and a front edge the second side wall, respectively, for a second predetermined distance.

25. A second enclosure for use with a crib, as described in claim 22, wherein the means for adjustably mounting said second enclosure to said first, second, third and fourth mounting rails further comprises:

first, second, third and fourth locking guide tube assemblies, each of said locking assemblies including a length of rigid tubing, said tubing sized and shaped to fit slidably over one the first, second, third and fourth mounting rails, means for attaching the locking assembly to the second enclosure, and means for releasably securing the locking assembly to one of the mounting rails;

said first locking guide assembly attached to the second enclosure at an intersection of a front edge and a top edge of the first side;

said second locking guide assembly attached to the second enclosure at an intersection of a back edge and the top edge of the first side;

said third locking guide assembly attached to the second enclosure at an intersection of a front edge and a top edge of the second side; and said fourth locking guide assembly attached to the second enclosure at an intersection of a back edge and the top edge of the second side.

26. A second enclosure for use with a crib, as described in claim 25, wherein the means for adjustably mounting said second enclosure to said first, second, third and fourth mounting rails further comprises:

first, second, third and fourth guide tube assemblies, each of said guide tube assemblies including a length of rigid tubing, said tubing sized and shaped to fit slidably over one the first, second, third and fourth mounting rails and means for attaching the guide tube assembly to the second enclosure;

said first guide tube assembly attached to the second enclosure at an intersection of the front edge and a bottom edge of the first side;

said second guide tube assembly attached to the second enclosure at an intersection of the back edge and the bottom edge of the first side;

said third guide tube assembly attached to the second enclosure at an intersection of the front edge and a bottom edge of the second side; and said fourth guide tube assembly attached to the second enclosure at an intersection of the front edge and the bottom edge of the second side.

27. A second enclosure for use with a crib, as described in claim 25, wherein means for releasably securing the locking guide tube assembly to one of the mounting rails further comprises:

a locking lever, said locking lever including a handle portion and extending to a pivot portion and further extending to a cam portion;

an orifice in the rigid tubing of the locking guide tube assembly, said orifice being sized, shaped, and disposed to permit the cam portion of the locking lever to bear upon one of the first, second, third and fourth mounting rails;

a pivot mounting, said pivot mounting affixed adjacent the orifice in the rigid tubing and being sized, shaped, and disposed to permit pivotal mounting of the pivot portion of the locking lever; and a pivot pin, said pin pivotally securing the locking lever to the pivot mounting such that the locking lever will secure the locking guide tube assembly to the mounting rail in a first position and permit the mounting rail to slide within the rigid tubing of the locking guide tube assembly in a second position.

28. A second enclosure for use with a crib, as described in claim 25, wherein means for releasably securing the locking guide tube assembly to one of the mounting rails further comprises:

a series of orifices, said orifices spaced along a length of each the first, second, third and fourth mounting rails;

a plunger pin, said plunger pin having a first end and a second end and having an operating knob at said first end and an engaging end at said second end, said engaging end sized and shaped to fit slidably within one of the orifices in the mounting rails;

a plunger pin housing, said housing being affixed to the locking guide tube assembly and being sized, shaped and disposed to position the plunger pin orthogonal to the mounting rail so that the plunger pin will engage the orifices in the mounting rail;

a return spring, said return spring disposed within the plunger pin housing and being sized, shaped and disposed to cause the plunger pin to be urged toward the mounting rail; and whereby, when the operating knob is withdrawn away from the mounting rail the plunger pin will be withdrawn from one of the orifices and the mounting rail will slide within the rigid tubing of the locking guide tube assembly and when the operating knob is released the plunger pin will engage one of the orifices in the mounting rail and the locking guide tube assembly will be secured thereto.

29. A second enclosure for use with a crib, as described in claim 25, wherein means for releasably securing the locking guide tube assembly to one of the mounting rails further comprises:

at least two vertical slits, said slits extending from a lower end of the rigid tubing of the locking guide tube assembly upwardly for a first predetermined distance;

an external tapered thread, said thread extending from the lower end of said rigid tubing upwardly for said first predetermined distance;

a threaded collar, said collar being sized, shaped, and disposed to threadedly engage the tapered thread of the rigid tubing; and whereby, when the threaded collar is rotated in a first, tightening direction the vertical slits will permit the rigid tubing to bear frictionally against one of the first, second, third and fourth mounting rails and when the threaded collar is rotated in a second, loosening direction the vertical slits will permit the rigid tubing to slide over one of the first, second, third and fourth mounting rails, thereby permitting vertical adjustment of the second enclosure.

30. A crib convertibly adapted for use as a co-sleeper, as described in claim 22, wherein the securing strap assembly for securing the crib to a parental bed further comprises:

a strap member of a length greater than twice the width of the parental bed and having a first end and a second end;

a resistance plate member having at least two slots vertically aligned and centrally disposed through which the strap member is threaded such that the first end and the second end are substantially equidistant from the plate member;

strap member receiving means fixedly attached to the first side wall and second side wall of the crib;

attachment cooperation means slidably engaged near the first end and near the second end of the strap member for reversible connection to the strap member receiving means;

means for adjusting the length of the strap member and fixedly tightening same after connecting the attachment cooperation means to the strap member receiving means; and wherein the strap member is properly positioned when disposed under a mattress of the parental bed and held in place by the resistance plate member disposed vertically at a side of the parental bed opposite placement of the crib and the strap member is tightened so the crib is held fast to the parental bed.

31. A crib convertibly adapted for use as a co-sleeper, as described in claim 22, wherein the securing strap assembly for securing the crib to a parental bed further comprises:

first and second guide slots, said guide slots sized, shaped and disposed upon the first and second side walls of the crib to constrain the strap member adjacent its first end and its second end, thereby more securely holding the crib to the parental bed.

32. A second enclosure for use with a crib, said crib comprising a rigid first enclosure of a first predetermined height, said first enclosure having an open top, a floor, a front wall, a back wall, a first side wall and a second side wall, said front wall being removably mounted to the crib, said second enclosure further comprising:

an open top, a floor, a front, a back, a first side and a second side;

first, second, third and fourth mounting rails, each of said rails having a first end and a second end;

said second and fourth mounting rails being disposed adjacent and bearing upon the back wall of the first enclosure;

a rear upper connecting rail, said front rail having a first end and a second end and being removably attached at its first end to the first end of the second mounting rail and removably attached at its second end to the first end of the fourth mounting rail;

a first side upper connecting rail, said first side rail having a first end and a second end and being removably attached at its first end to the first end of the second mounting rail and removably attached at its second end to the first end of the first mounting rail;

a second side upper connecting rail, said second side rail having a first end and a second end and being removably attached at its first end to the first end of the fourth mounting rail and removably attached at its second end to the first end of the third mounting rail;

four mounting feet, each of said feet being sized and shaped to attach to the second end of one of the first, second, third and fourth mounting rails and to grip frictionally the floor of the first enclosure;

means for adjustably mounting said second enclosure to said first, second, third and fourth mounting rails within said first enclosure at at least one predetermined distance from the top of the first enclosure;

a securing strap assembly for securing the crib to a parental Ed; and wherein when the front wall is removed from the crib and the second enclosure is mounted within said first enclosure and the securing strap assembly is properly positioned and the crib is secured to the parental bed the crib will serve as a co-sleeper.

33. A second enclosure for use with a crib, as described in claim 32, wherein the back, first side and second side of the second enclosure are of a second predetermined height and the front of the second enclosure is of a third predetermined height, less than the second predetermined height.

34. A second enclosure for use with a crib, as described in claim 32, wherein the first side and the second side of the second enclosure extend past a front edge of the first side wall and a front edge the second side wall, respectively, for a second predetermined distance.

35. A second enclosure for use with a crib, as described in claim 32, wherein the means for adjustably mounting said second enclosure to said first, second, third and fourth mounting rails further comprises:

first, second, third and fourth locking guide tube assemblies, each of said locking assemblies including a length of rigid tubing, said tubing sized and shaped to fit slidably over one the first, second, third and fourth mounting rails, means for attaching the locking assembly to the second enclosure, and means for releasably securing the locking assembly to one of the mounting rails;

said first locking guide assembly attached to the second enclosure at an intersection of a front edge and a top edge of the first side;

said second locking guide assembly attached to the second enclosure at an intersection of a back edge and the top edge of the first side;

said third locking guide assembly attached to the second enclosure at an intersection of a front edge and a top edge of the second side; and said fourth locking guide assembly attached to the second enclosure at an intersection of a back edge and the top edge of the second side.

36. A second enclosure for use with a crib, as described in claim 32, wherein the means for adjustably mounting said second enclosure to said first, second, third and fourth mounting rails further comprises:

first, second, third and fourth guide tube assemblies, each of said guide tube assemblies including a length of rigid tubing, said tubing sized and shaped to fit slidably over one the first, second, third and fourth mounting rails and means for attaching the guide tube assembly to the second enclosure;

said first guide tube assembly attached to the second enclosure at an intersection of the front edge and a bottom edge of the first side;

said second guide tube assembly attached to the second enclosure at an intersection of the back edge and the bottom edge of the first side;

said third guide tube assembly attached to the second enclosure at an intersection of the front edge and a bottom edge of the second side; and said fourth guide tube assembly attached to the second enclosure at an intersection of the front edge and the bottom edge of the second side.

37. A second enclosure for use with a crib, as described in claim 35, wherein means for releasably securing the locking guide tube assembly to one of the mounting rails further comprises:

a locking lever, said locking lever including a handle portion and extending to a pivot portion and further extending to a cam portion;

an orifice in the rigid tubing of the locking guide tube assembly, said orifice being sized, shaped, and disposed to permit the cam portion of the locking lever to bear upon one of the first, second, third and fourth mounting rails;

a pivot mounting, said pivot mounting affixed adjacent the orifice in the rigid tubing and being sized, shaped, and disposed to permit pivotal mounting of the pivot portion of the locking lever; and a pivot pin, said pin pivotally securing the locking lever to the pivot mounting such that the locking lever will secure the locking guide tube assembly to the mounting rail in a first position and permit the mounting rail to slide within the rigid tubing of the locking guide tube assembly in a second position.

38. A second enclosure for use with a crib, as described in claim 35, wherein means for releasably securing the locking guide tube assembly to one of the mounting rails further comprises:

a series of orifices, said orifices spaced along a length of each the first, second, third and fourth mounting rails;

a plunger pin, said plunger pin having a first end and a second end and having an operating knob at said first end and an engaging end at said second end, said engaging end sized and shaped to fit slidably within one of the orifices in the mounting rails;

a plunger pin housing, said housing being affixed to the locking guide tube assembly and being sized, shaped and disposed to position the plunger pin orthogonal to the mounting rail so that the plunger pin will engage the orifices in the mounting rail;

a return spring, said return spring disposed within the plunger pin housing and being sized, shaped and disposed to cause the plunger pin to be urged toward the mounting rail; and whereby, when the operating knob is withdrawn away from the mounting rail the plunger pin will be withdrawn from one of the orifices and the mounting rail will slide within the rigid tubing of the locking guide tube assembly and when the operating knob is released the plunger pin will engage one of the orifices in the mounting rail and the locking guide tube assembly will be secured thereto.

39. A second enclosure for use with a crib, as described in claim 35, wherein means for releasably securing the locking guide tube assembly to one of the mounting rails further comprises:

at least two vertical slits, said slits extending from a lower end of the rigid tubing of the locking guide tube assembly upwardly for a first predetermined distance;

an external tapered thread, said thread extending from the lower end of said rigid tubing upwardly for said first predetermined distance;

a threaded collar, said collar being sized, shaped, and disposed to threadedly engage the tapered thread of the rigid tubing; and whereby, when the threaded collar is rotated in a first, tightening direction the vertical slits will permit the rigid tubing to bear frictionally against one of the first, second, third and fourth mounting rails and when the threaded collar is rotated in a second, loosening direction the vertical slits will permit the rigid tubing to slide over one of the first, second, third and fourth mounting rails, thereby permitting vertical adjustment of the second enclosure.

40. A crib convertibly adapted for use as a co-sleeper, as described in claim 32, further comprising:

at least one pair of tensioning devices, said tensioning devices having a threaded rod, said rod having a first end and a second end, and an attachment plate, said plate being orthogonaly mounted to the first end of the threaded rod;

at least one pair of threaded orifices, said orifices passing orthogonaly through at least two of the second and fourth mounting rails and the first and third mounting rails, and being sized, shaped, and disposed to receive threadedly the second end of the threaded rods of the tensioning devices such that the threaded rods are collinear; and whereby, when the threaded rods of the tensioning devices are rotated outwardly from two of the second and fourth mounting rails and the first and third mounting rails the attachment plates will bear against the first side wall and the second side wall of the crib, thereby stabilizing the second enclosure within the crib.

41. A crib convertibly adapted for use as a co-sleeper, as described in claim 40, wherein the tensioning device further comprises a stabilizing point, said point being collinear with the threaded rod and mounted orthogonaly to the attachment plate, thereby preventing movement of the second enclosure with respect to the crib.

42. A crib convertibly adapted for use as a co-sleeper, as described in claim 32, wherein the securing strap assembly for securing the crib to a parental bed further comprises:

a strap member of a length greater than twice the width of the parental bed and having a first end and a second end;

a resistance plate member having at least two slots vertically aligned and centrally disposed through which the strap members is threaded such that the first end and the second end are substantially equidistant from the plate member;

strap member receiving means fixedly attached to the first and second sides of the crib;

attachment cooperation means slidably engaged near the first end and near the second end of the strap member for reversible connection to the strap member receiving means;

means for adjusting the length of the strap member and fixedly tightening same after connecting the attachment cooperation means to the strap member receiving means; and wherein the strap member is properly positioned when disposed under the mattress of the parental bed and held in place by the resistance plate disposed vertically at the side of the parental bed opposite placement of the crib and the strap member is tightened so the co-sleeper is held fast to the parental bed.

43. A crib convertibly adapted for use as a co-sleeper, as described in claim 32, wherein the securing strap assembly for securing the crib to a parental bed further comprises:

first and second guide slots, said guide slots sized, shaped and disposed upon the first and second side walls of the crib to constrain the strap member adjacent its first end and its second end, thereby more securely holding the crib to the parental bed.

44. A crib convertibly adapted for use as a co-sleeper comprising:

a rigid first enclosure, said first enclosure having an open top, a floor, a front wall, a back wall, a first side wall and a second side wall said front wall being removably mounted to the crib;

said first enclosure being of a first predetermined height;

a second enclosure, said second enclosure having an open top, a floor, a front, a back, a first side and a second side;

first, second, third and fourth mounting rails, each of said rails having a first end and a second end;

four mounting feet, each of said feet being sized and shaped to attach to the second end of one of the first, second, third and fourth mounting rails and to grip frictionally the floor of the first enclosure;

means for adjustably mounting said second enclosure to said first, second, third and fourth mounting rails within said first enclosure at at least one predetermined distance from the top of the first enclosure;

a securing strap assembly for securing the crib to a parental bed; and wherein when the front wall is removed from the crib and the second enclosure is mounted within said first enclosure and the ,curing strap assembly is properly positioned and the crib is secured to the parental bed the crib will serve as a co-sleeper.

45. A crib convertibly adapted for use as a co-sleeper, as described in claim 44, further comprising:

at least one pair of tensioning devices, said tensioning devices having a threaded rod, said rod having a first end and a second end, and an attachment plate, said plate being orthogonaly mounted to the first end of the threaded rod;

at least one pair of threaded orifices, said orifices passing orthogonaly through at least two of the second and fourth mounting rails and the first and third mounting rails, and being sized, shaped, and disposed to receive threadedly the second end of the threaded rods of the tensioning devices such that the threaded rods are collinear; and whereby, when the threaded rods of the tensioning devices are rotated outwardly from two of the second and fourth mounting rails and the first and third mounting rails the attachment plates will bear against the first side wall and the second side wall of the crib, thereby stabilizing the second enclosure within the crib.

46. A crib convertibly adapted for use as a co-sleeper, as described in claim 45, wherein the tensioning device further comprises a stabilizing point, said point being collinear with the threaded rod and mounted orthogonaly to the attachment plate, thereby preventing movement of the second enclosure with respect to the crib.

47. A crib convertibly adapted for use as a co-sleeper, as described in claim 44, wherein the back, first side and second side of the second enclosure are of a second predetermined height and the front of the second enclosure is of a third predetermined height, less than the second predetermined height.

48. A crib convertibly adapted for use as a co-sleeper, as described in claim 44, wherein the first side and the second side of the second enclosure extend past a front edge of the first side wall and a front edge the second side wall, respectively, for a second predetermined distance.

49. A crib convertibly adapted for use as a co-sleeper, as described in claim 45 wherein the means for adjustably mounting said second enclosure to said first, second, third and fourth mounting rails further comprises:

first, second, third and fourth locking guide tube assemblies, each of said locking assemblies including a length of rigid tubing, said tubing sized and shaped to fit slidably over one the first, second, third and fourth mounting rails, means for attaching the locking assembly to the second enclosure, and means for releasably securing the locking assembly to one of the mounting rails;

said first locking guide assembly attached to the second enclosure at an intersection of a front edge and a top edge of the first side;

said second locking guide assembly attached to the second enclosure at an intersection of a back edge and the top edge of the first side;

said third locking guide assembly attached to the second enclosure at an intersection of a front edge and a top edge of the second side; and said fourth locking guide assembly attached to the second enclosure at an intersection of a back edge and the top edge of the second side.

50. A crib convertibly adapted for use as a co-sleeper, as described in claim 49, wherein the means for releasably securing the locking guide tube assemblies to the mounting rails further comprises:

a locking lever, said locking lever including a handle portion and extending to a pivot portion and further extending to a cam portion;

an orifice in the rigid tubing of the locking guide tube assembly, said orifice being sized, shaped, and disposed to permit the cam portion of the locking lever to bear upon one of the first, second, third and fourth mounting rails;

a pivot mounting, said pivot mounting affixed adjacent the orifice in the rigid tubing and being sized, shaped, and disposed to permit pivotal mounting of the pivot portion of the locking lever; and a pivot pin, said pin pivotally securing the locking lever to the pivot mounting such that the locking lever will secure the locking guide tube assembly to the mounting rail in a first position and permit the mounting rail to slide within the rigid tubing of the locking guide tube assembly in a second position.

51. A crib convertibly adapted for use as a co-sleeper, as described in claim 49, wherein means for releasably securing the locking guide tube assembly to one of the mounting rails further comprises:

a series of orifices, said orifices spaced along a length of each the first, second, third and fourth mounting rails;

a plunger pin, said plunger pin having a first end and a second end and having an operating knob at said first end and an engaging end at said second end, said engaging end sized and shaped to fit slidably within one of the orifices in the mounting rails;

a plunger pin housing, said housing being affixed to the locking guide tube assembly and being sized, shaped and disposed to position the plunger pin orthogonal to the mounting rail so that the plunger pin will engage the orifices in the mounting rail;

a return spring, said return spring disposed within the plunger pin housing and being sized, shaped and disposed to cause the plunger pin to be urged toward the mounting rail; and whereby, when the operating knob is withdrawn away from the mounting rail the plunger pin will be withdrawn from one of the orifices and the mounting rail will slide within the rigid tubing of the locking guide tube assembly and when the operating knob is released the plunger pin will engage one of the orifices in the mounting rail and the locking guide tube assembly will be secured thereto.

52. A crib convertibly adapted for use as a co-sleeper, as described in claim 49, wherein means for releasably securing the locking guide tube assemblies to the mounting rails further comprises:

at least two vertical slits, said slits extending from a lower end of the rigid tubing of the locking guide tube assembly upwardly for a first predetermined distance;

an external tapered thread, said thread extending from the lower end of said rigid tubing upwardly for said first predetermined distance;

a threaded collar, said collar being sized, shaped, and disposed to threadedly engage the tapered thread of the rigid tubing; and whereby, when the threaded collar is rotated in a first, tightening direction the vertical slits will permit the rigid tubing to bear frictionally against one of the first, second, third and fourth mounting rails and when the threaded collar is rotated in a second, loosening direction the vertical slits will permit the rigid tubing to slide over one of the first, second, third and fourth mounting rails, thereby permitting vertical adjustment of the second enclosure.

53. A second enclosure for use with a crib, said crib comprising a rigid first enclosure of a first predetermined height, said first enclosure having an open top, a floor, a front wall, a back wall, a first side wall and a second side wall, said front wall being removably mounted to the crib, said second enclosure further comprising:

an open top, a floor, a front, a back, a first side and a second side;

first, second, third and fourth mounting rails, each of said rails having a first end and a second end;

four mounting feet, each of said feet being sized and shaped to attach to the second end of one of the first, second, third and fourth mounting rails and to grip frictionally the floor of the first enclosure;

means for adjustably mounting said second enclosure to said first, second, third and fourth mounting rails within said first enclosure at at least one predetermined distance from the top of the first enclosure;

a securing strap assembly for securing the crib to a parental bed; and wherein when the front wall is removed from the crib and the second enclosure is mounted within said first enclosure and the securing strap assembly is properly positioned and the crib is secured to the parental bed the crib will serve as a co-sleeper.

54. A second enclosure for use with a crib, as described in claim 53, wherein the back, first side and second side of the second enclosure are of a second predetermined height and the front of the second enclosure is of a third predetermined height, less than the second predetermined height.

55. A second enclosure for use with a crib, as described in claim 53, wherein the first side and the second side of the second enclosure extend past a front edge of the first side wall and a front edge the second side wall, respectively, for a second predetermined distance.

56. A second enclosure for use with a crib, as described in claim 53, wherein the means for adjustably mounting said second enclosure to said first, second, third and fourth mounting rails further comprises:

first, second, third and fourth locking guide tube assemblies, each of said locking guide tube assemblies including a length of rigid tubing, said tubing sized and shaped to fit slidably over one the first, second, third and fourth mounting rails, means for attaching the locking guide tube assembly to the second enclosure, and means for releasably securing the locking guide tube assembly to one of the mounting rails;

said first locking guide tube assembly attached to the second enclosure at an intersection of a front edge and a top edge of the first side;

said second locking guide tube assembly attached to the second enclosure at an intersection of a back edge and the top edge of the first side;

said third locking guide tube assembly attached to the second enclosure at an intersection of a front edge and a top edge of the second side; and said fourth locking guide tube assembly attached to the second enclosure at an intersection of a back edge and the top edge of the second side.

57. A second enclosure for use with a crib, as described in claim 56, wherein means for releasably securing the locking guide tube assembly to one of the mounting rails further comprises:

a locking lever, said locking lever including a handle portion and extending to a pivot portion and further extending to a cam portion;

an orifice in the rigid tubing of the locking guide tube assembly, said orifice being sized, shaped, and disposed to permit the can portion of the locking lever to bear upon one of the first, second, third and fourth mounting rails;

a pivot mounting, said pivot mounting affixed adjacent the orifice in the rigid tubing and being sized, shaped, and disposed to permit pivotal mounting of the pivot portion of the locking lever; and a pivot pin, said pin pivotally securing the locking lever to the pivot mounting such that the locking lever will secure the locking guide tube assembly to the mounting rail in a first position and permit the mounting rail to slide within the rigid tubing of the locking guide tube assembly in a second position.

58. A second enclosure for use with a crib, as described in claim 56, wherein means for releasably securing the locking guide tube assembly to one of the mounting rails further comprises:

a series of orifices, said orifices spaced along a length of each the first, second, third and fourth mounting rails;

a plunger pin, said plunger pin having a first end and a second end and having an operating knob at said first end and an engaging end at said second end, said engaging end sized and shaped to fit slidably within one of the orifices in the mounting rails;

a plunger pin housing, said housing being affixed to the locking guide tube assembly and being sized, shaped and disposed to position the plunger pin orthogonal to the mounting rail so that the plunger pin will engage the orifices in the mounting rail;

a return spring, said return spring disposed within the plunger pin housing and being sized, shaped and disposed to cause the plunger pin to be urged toward the mounting rail; and whereby, when the operating knob is withdrawn away from the mounting rail the, plunger pin will be withdrawn from one of the orifices and the mounting rail will slide within the rigid tubing of the locking guide tube assembly and when the operating knob is released the plunger pin will engage one of the orifices in the mounting rail and the locking guide tube assembly will be secured thereto.

59. A second enclosure for use with a crib, as described in claim 56, wherein means for releasably securing the locking guide tube assembly to one of the mounting rails further comprises:

at least two vertical slits, said slits extending from a lower end of the rigid tubing of the locking guide tube assembly upwardly for a first predetermined distance;

an external tapered thread, said thread extending from the lower end of said rigid tubing upwardly for said first predetermined distance;

a threaded collar, said collar being sized, shaped, and disposed to threadedly engage the tapered thread of the rigid tubing; and whereby, when the threaded collar is rotated in a first, tightening direction the vertical slits will permit the rigid tubing to bear frictionally against one of the first, second, third and fourth mounting rails and when the threaded collar is rotated in a second, loosening direction the vertical slits will permit the rigid tubing to slide over one of the first, second, third and fourth mounting rails, thereby permitting vertical adjustment of the second enclosure.

60. A crib convertibly adapted for use as a co-sleeper, as described in claim 53, further comprising:

at least one pair of tensioning devices, said tensioning devices having a threaded rod, said rod having a first end and a second end, and an attachment plate, said plate being orthogonaly mounted to the first end of the threaded rod;

at least one pair of threaded orifices, said orifices passing orthogonaly through at least two of the second and fourth mounting rails and the first and third mounting rails, and being sized, shaped, and disposed to receive threadedly the second end of the threaded rods of the tensioning devices such that the threaded rods are collinear; and whereby, when the threaded rods of the tensioning devices are rotated outwardly from two of the second and fourth mounting rails and the first and third mounting rails the attachment plates will bear against the first side wall and the second side wall of the crib, thereby stabilizing the second enclosure within the crib.

61. A crib convertibly adapted for use as a co-sleeper, as described in claim 60, wherein the tensioning device further comprises a stabilizing point, said point being collinear with the threaded rod and mounted orthogonaly to the attachment plate, thereby preventing movement of the second enclosure with respect to the crib.

62. A crib convertibly adapted for use as a co-sleeper, as described in claim 53, wherein the securing strap assembly for securing the crib to a parental bed further comprises:

a strap member of a length greater than twice the width of the parental bed and having a first end and a second end;

a resistance plate member having at least two slots vertically aligned and centrally disposed through which the strap members is threaded such that the first end and the second end are substantially equidistant from the plate member;

strap member receiving means fixedly attached to the first and second sides of the crib;

attachment cooperation means slidably engaged near the first end and near the second end of the strap member for reversible connection to the strap member receiving means;

means for adjusting the length of the strap member and fixedly tightening same after connecting the attachment cooperation means to the strap member receiving means; and wherein the strap member is properly positioned when disposed under the mattress of the parental bed and held in place by the resistance plate disposed vertically at the side of the parental bed opposite placement of the crib and the strap member is tightened so the co-sleeper is held fast to the parental bed.

63. A crib convertibly adapted for use as a co-sleeper, as described in claim 53, wherein the securing strap assembly for securing the crib to a parental bed further comprises:

first and second guide slots, said guide slots sized, shaped and disposed upon the first and second side walls of the crib to constrain the strap member adjacent its first end and its second end, thereby more securely holding the crib to the parental bed.

* * * * *